US010794050B2

(12) United States Patent
Shinohara et al.

(10) Patent No.: US 10,794,050 B2
(45) Date of Patent: Oct. 6, 2020

(54) DISCHARGE VALVE OPERATING DEVICE, FLUSH WATER TANK DEVICE, AND FLUSH TOILET

(71) Applicant: TOTO LTD., Kitakyushu-shi, Fukuoka (JP)

(72) Inventors: Koki Shinohara, Kitakyushu (JP); Hideki Tanimoto, Kitakyushu (JP); Makoto Abe, Kitakyushu (JP)

(73) Assignee: TOTO LTD., Kitakyushu-shi, Fukuoka (JP)

( * ) Notice: Subject to any disclaimer, the term of this patent is extended or adjusted under 35 U.S.C. 154(b) by 49 days.

(21) Appl. No.: 16/267,991

(22) Filed: Feb. 5, 2019

(65) Prior Publication Data

US 2019/0249404 A1 Aug. 15, 2019

(30) Foreign Application Priority Data

Feb. 15, 2018 (JP) ..... 2018-024879

(51) Int. Cl.
*E03D 5/10* (2006.01)
*E03D 5/092* (2006.01)

(52) U.S. Cl.
CPC ..... *E03D 5/10* (2013.01); *E03D 5/092* (2013.01)

(58) Field of Classification Search
CPC .. E03D 1/144; E03D 1/26; E03D 1/35; E03D 5/09; E03D 5/092; E03D 5/094; E03D 5/10; E03D 5/105
See application file for complete search history.

(56) References Cited

U.S. PATENT DOCUMENTS 2,412,738 A * 12/1946 Martin ..... E03D 5/094 4/412
3,324,481 A * 6/1967 Emerson ..... E03D 5/09 4/357
5,960,482 A * 10/1999 Chang ..... E03D 1/308 4/325

(Continued)

FOREIGN PATENT DOCUMENTS

CN 201202160 Y 3/2009
CN 104947763 A 9/2015

(Continued)

OTHER PUBLICATIONS

Office Action issued in Chinese Patent Application No. 201910079272.8, dated Jun. 3, 2020 [with machine-generated translation].

*Primary Examiner* — J C Jacyna
(74) *Attorney, Agent, or Firm* — BakerHostetler

(57) ABSTRACT

A discharge valve operating device includes an electric operation unit including a rotating shaft, a first coupling member and a second coupling member having respective one ends coupled to a discharge valve, a first rotary winding member, and a second rotary winding member. The first rotary winding member and the second rotary winding member include a first holed portion and a second holed portion, respectively, which are provided near portions at respective rotation centers. Each holed portion is engageable and disengageable with the rotating shaft in a rotation direction in accordance with the rotation direction of the rotating shaft in each operation mode.

16 Claims, 22 Drawing Sheets

(56) References Cited

U.S. PATENT DOCUMENTS

| | | | | |
|---|---|---|---|---|
| 8,201,283 | B2 * | 6/2012 | Ciski | E03D 5/094 4/325 |
| 9,340,962 | B2 * | 5/2016 | Tanimoto | E03D 5/094 |
| 9,447,569 | B2 * | 9/2016 | Shinohara | E03D 5/094 |
| 9,890,527 | B2 * | 2/2018 | Shinohara | E03D 5/09 |
| 2007/0151008 | A1 * | 7/2007 | Hayashi | E03D 5/09 4/300 |
| 2014/0123378 | A1 | 5/2014 | Luettgen et al. | |
| 2014/0289946 | A1 | 10/2014 | Tanimoto et al. | |
| 2015/0267387 | A1 * | 9/2015 | Shinohara | E03D 1/34 4/313 |
| 2015/0275492 | A1 | 10/2015 | Momoe et al. | |
| 2018/0216329 | A1 * | 8/2018 | Tanimoto | E03D 1/35 |

FOREIGN PATENT DOCUMENTS

| | | | |
|---|---|---|---|
| CN | 105089125 | A | 11/2015 |
| CN | 107143014 | A | 9/2017 |
| JP | 2014-190131 | A | 10/2014 |
| JP | 2015-196949 | A | 11/2015 |

* cited by examiner

DISCHARGE VALVE OPERATING DEVICE, FLUSH WATER TANK DEVICE, AND FLUSH TOILET

BACKGROUND OF THE INVENTION

Field of the Invention

The present invention relates to a discharge valve operating device, a flush water tank device, and a flush toilet and, more particularly, to a discharge valve operating device for performing valve opening operation of a discharge valve in a flush water tank device which supplies flush water to a toilet, a flush water tank device, and a flush toilet.

Description of the Related Art

As examples of a discharge valve operating device which performs valve opening operation of a discharge valve in a flush water tank device which supplies flush water to a toilet, there have been known discharge valve operating devices as described in Patent Literatures 1 to 4 below.

In the conventional discharge valve operating device described in Patent Literature 1 (Japanese Patent Laid-Open No. 2014-190131), a common rotary winding member is manually rotated in a predetermined direction by rotationally operating an operation handle in a predetermined direction, the rotary winding member winds up a single operation wire coupled to a discharge valve, and valve opening operation is performed.

In the conventional discharge valve operating device described in Patent Literature 2 (Japanese Patent Laid-Open No. 2015-196949), there is also known a discharge valve operating device capable of performing valve opening operation by manually pulling up a single common operation wire coupled to a discharge valve by a manual operation unit and of performing valve opening operation by automatically pulling up the single common operation wire by an electric drive unit.

In the conventional discharge valve operating device described in Patent Literature 2, a pull-up amount of the operation wire is set large at the time of execution in a full-flush mode large in flush water amount and is set small at the time of execution in a partial-flush mode small in flush water amount.

Additionally, the conventional discharge valve operating device described in Patent Literature 3 (U.S. Patent Laid-Open No. 2014/123378) includes a disk-shaped rotary member which rotates by being electrically driven and a single chain having one end connected to the rotary member and the other end connected to a discharge valve. Pulling up the single chain by electrically rotationally operating the rotary member allows valve opening operation of the discharge valve.

The conventional discharge valve operating device described in Patent Literature 4 (Chinese Patent Laid-Open No. 105089125) includes a disk-shaped rotary member which rotates by being electrically driven and a connection member, such as a single wire, having one end connected to a discharge valve. A horizontally long slit is formed in the rotary member in a diametrical direction, and a connection portion at the other end of the connection member is slidably connected to the slit. With this configuration, the connection portion of the connection member moves along the slit to a slit end portion in accordance with a rotation amount when the rotary member makes a normal rotation or a reverse rotation by being electrically driven, and a pull-up amount of the discharge valve is adjusted.

In recent years, in order to pursue the ease of use of a discharge valve operating device, automation of valve opening operation of a discharge valve has been realized by electrification or the like, without sticking to direct manual operation by a user.

Even if such automation can be realized, installation space for a discharge valve operating device may be limited, and an associated part, such as a wire which pulls up a discharge valve, may interfere with a part surrounding the associated part during operation of the operating device, depending on a layout on the discharge valve side and design circumstances. The factors cause the problem of a reduction in the operability of the operating device.

Thus, how to improve the operability of a discharge valve operating device in accordance with a layout on the discharge valve side and design circumstances has been a problem requested to be solved in recent years.

SUMMARY OF THE INVENTION

Under the circumstances, the present invention has been made to solve problems with the above-described conventional techniques and the problem requested to be solved in recent years and has as its object to provide a discharge valve operating device capable of improving the operability of valve opening operation of a discharge valve and accurately executing toilet flushing in accordance with a plurality of flush modes, a flush water tank device, and a flush toilet.

In order to solve the above-described problems, there is provided a discharge valve operating device configured to perform valve opening operation of a discharge valve in a flush water tank device which supplies flush water to a toilet, comprising: an operation device including a rotating shaft and being operated by first and second operation modes, the operating portion being configured to rotate the rotating shaft in a first direction on the first operation mode and to rotate the rotating shaft in a second direction opposite to the first rotation direction on the second operation mode; first and second coupling members in which each one end of the first and second coupling members is coupled to the discharge valve; a first rotary winding member configured to be mounted to the rotating shaft so as to be engageable and disengageable in a rotation direction, an other end of the first coupling member being coupled to the first rotary winding member, the first rotary winding member being configured to wind up the first coupling member when the first rotary winding member rotates together with the rotating shaft in the first rotation direction; and a second rotary winding member configured to be mounted to the rotating shaft so as to be engageable and disengageable in the rotation direction, an other end of the second coupling member being coupled to the second rotary winding member, the second rotary winding member being configured to wind up the second coupling member when the second rotary winding member rotates together with the rotating shaft in the second rotation direction, independently of the first rotary winding member, wherein the first rotary winding member and the second rotary winding member respectively include a first holed portion and a second holed portion, which are provided near respective rotation centers, and each of the holed portions is engageable and disengageable with/from the rotating shaft in the rotation direction in accordance with the rotation direction of the rotating shaft in each of the operation modes, when the rotating shaft is rotated in the first rotation direction in the first operation mode of the operation device, the first holed portion of the first rotary winding member is configured to rotate in the first rotation direction in a state of being engaged with the rotating shaft in the rotation direction while the second holed portion of the second rotary winding member is configured to be brought out of engagement with the rotating shaft in the rotation direction and enter a stationary state, and the discharge valve is configured to be pulled up by a first amount when the first coupling member alone is wound up by the first amount by the first rotary winding member, and toilet flushing in a first flush mode is executable when a first flush water amount of flush water is supplied from the flush water tank device to the toilet, and when the rotating shaft is rotated in the second rotation direction in the second operation mode of the operation device, the first holed portion of the first rotary winding member is configured to be brought out of engagement with the rotating shaft in the rotation direction and enter a stationary state while the second holed portion of the second rotary winding member is configured to rotate in the second rotation direction in a state of being engaged with the rotating shaft in the rotation direction, and the discharge valve is configured to be pulled up by a second amount different from the first amount when the second coupling member alone is wound up by the second amount by the second rotary winding member, and toilet flushing in a second flush mode is executable when a second flush water amount different from the first flush water amount of flush water is supplied from the flush water tank device to the toilet.

According to the present invention configured in the above-described manner, at the time of execution in each of the first flush mode and the second flush mode that are different in flush water amount, if the rotating shaft is rotated in the first rotation direction in the first operation mode of the operation device, the first holed portion of the first rotary winding member rotates in the first rotation direction in the state of being engaged with the rotating shaft in the rotation direction. With this rotation, the first rotary winding member together with the rotating shaft rotates in the first rotation direction, independently of the second rotary winding member. At this time, since the second holed portion of the second rotary winding member is out of engagement with the rotating shaft in the rotation direction, the second rotary winding member is in the stationary state.

The first coupling member alone is wound up by the first amount by the first rotary winding member, and the discharge valve is pulled up by the first amount. This causes the first flush water amount of flush water to be supplied from the flush water tank device to the toilet to execute the toilet flushing in the first flush mode.

If the rotating shaft is rotated in the second rotation direction in the second operation mode of the operation device, the first holed portion of the first rotary winding member is brought out of engagement with the rotating shaft in the rotation direction and enters the stationary state.

In the meantime, the second holed portion of the second rotary winding member rotates in the second rotation direction in the state of being engaged with the rotating shaft in the rotation direction. With this rotation, the second rotary winding member together with the rotating shaft rotates in the second rotation direction, independently of the first rotary winding member.

The second coupling member alone is wound up by the second amount different from the first amount by the second rotary winding member, and the discharge valve is pulled up by the second amount. This causes the second flush water amount, different from the first flush water amount, of flush water to be supplied from the flush water tank device to the toilet to execute the toilet flushing in the second flush mode.

Thus, either one of the first rotary winding member and the second rotary winding member can be independently rotated in accordance with each operation mode of the operation device, and the first rotary winding member and the second rotary winding member can operate smoothly while suppressing interference with each other.

The first coupling member and the second coupling member coupled to the first rotary winding member and the second rotary winding member, respectively, can also operate smoothly while suppressing interference with each other.

Since switching operation between the first operation mode and the second operation mode that are different operation modes of the operation device can be accurately and smoothly performed, valve opening operation of the discharge valve corresponding to each flush mode can be accurately performed.

As a result, the operability of the discharge valve operating device that performs the valve opening operation of the discharge valve can be improved, and toilet flushing corresponding to each of a plurality of flush modes can be accurately executed.

According to the present invention, preferably, the operation device is an electric operation device which includes an electric rotating shaft coupled to the rotating shaft and capable of electrically rotationally driving the rotating shaft by external power, and the first rotary winding member and the second rotary winding member are rotatable with rotation radiuses larger than respective rotation radiuses of the electric rotating shaft and the rotating shaft by being rotationally driven by the electric rotating shaft.

According to the present invention configured in the above-described manner, at the time of execution in each of the first flush mode and the second flush mode that are different in flush water amount, the electric operation device electrically rotates the electric rotating shaft in accordance with each operation mode.

At this time, either one of the first rotary winding member and the second rotary winding member, together with the rotating shaft and the electric rotating shaft, can rotate independently and automatically rotate with the rotation radius larger than the rotation radiuses of the rotating shaft and the electric rotating shaft in a different direction corresponding to each flush mode.

If the electric operation unit rotates the electric rotating shaft in the first operation mode, and the first rotary winding member together with the rotating shaft rotates automatically in the first rotation direction, the first coupling member alone can be automatically wound up by the first amount by the first rotary winding member, and the discharge valve together with the first coupling member can be pulled up by a relatively large pull-up amount.

Similarly, if the electric operation device rotates the electric rotating shaft in the second operation mode, and the second rotary winding member together with the rotating shaft rotates automatically in the second rotation direction, the second coupling member alone can be automatically wound up by the second amount by the second rotary winding member, and the discharge valve together with the second coupling member can be pulled up by a relatively small pull-up amount.

According to the present invention, preferably, the operation device is a manual operation device which includes an operation member coupled to the rotating shaft and capable of manually rotationally driving the rotating shaft.

According to the present invention configured in the above-described manner, at the time of execution in each of the first flush mode and the second flush mode that are different in flush water amount, the rotating shaft is manually rotated in accordance with each operation mode by manually rotationally operating the operation member of the manual operation device.

At this time, either one of the first rotary winding member and the second rotary winding member, together with the rotating shaft, can rotate independently in a different direction corresponding to each flush mode.

If the rotating shaft is rotated through manual operation in the first operation mode of the operation member of the manual operation device, and the first rotary winding member together with the rotating shaft rotates in the first rotation direction, the first coupling member alone is wound up by the first amount by the first rotary winding member, and the discharge valve can be pulled up together with the first coupling member by a relatively large pull-up amount.

Similarly, if the rotating shaft is rotated through manual operation in the second operation mode of the operation member of the manual operation device, and the second rotary winding member together with the rotating shaft rotates in the second rotation direction, the second coupling member alone is wound up by the second amount by the second rotary winding member, and the discharge valve can be pulled up together with the second coupling member by a relatively small pull-up amount.

According to the present invention, preferably, the first rotary winding member is rotatable independently with the rotation radius that is almost identical to the rotation radius of the second rotary winding member between an initial position where the discharge valve is closed and is at a lowest position and a first maximum rotation position where the discharge valve is opened and is at a first highest position in the first operation mode of the operation device, the second rotary winding member is rotatable independently with the rotation radius that is almost identical to the rotation radius of the first rotary winding member between the initial position and a second maximum rotation position where the discharge valve is opened and is at a second highest position different from the first highest position in the second operation mode of the operation device, a first maximum rotation angle when the first rotary winding member rotates from the initial position to the first maximum rotation position in the first rotation direction is set larger than a second maximum rotation angle when the second rotary winding member rotates from the initial position to the second maximum rotation position in the second rotation direction, and the first amount, by which the first coupling member alone is wound up by the first rotary winding member, is set larger than the second amount, by which the second coupling member alone is wound up by the second rotary winding member, and the first flush water amount for supply from the flush water tank device to the toilet in the first flush mode is set larger than the second flush water amount for supply from the flush water tank device to the toilet in the second flush mode.

According to the present invention configured in the above-described manner, if the rotating shaft is rotated in the first rotation direction in the first operation mode of the operation device, the first holed portion of the first rotary winding member rotates in the first rotation direction in the state of being engaged with the rotating shaft in the rotation direction.

For this reason, the first rotary winding member is rotatable from the initial position where the discharge valve is closed and is at the lowest position to the first maximum rotation position in the first rotation direction within a range of the first maximum rotation angle and rotates with the rotation radius almost identical to the rotation radius of the second rotary winding member, independently of the second rotary winding member. At this time, since the second holed portion of the second rotary winding member is out of engagement with the rotating shaft in the rotation direction, the second rotary winding member is in the stationary state.

The first coupling member alone is wound up by the first amount (an amount larger than the second amount) by the first rotary winding member, and the discharge valve is pulled up by the first amount. This causes the first flush water amount (a flush water amount larger than the second flush water amount) of flush water to be supplied from the flush water tank device to the toilet to execute the toilet flushing in the first flush mode.

If the rotating shaft is rotated in the second rotation direction in the second operation mode of the operation device, the first holed portion of the first rotary winding member is brought out of engagement with the rotating shaft in the rotation direction and enters the stationary state.

In the meantime, the second holed portion of the second rotary winding member rotates in the second rotation direction in the state of being engaged with the rotating shaft in the rotation direction. For this reason, the second rotary winding member is rotatable from the initial position where the discharge valve is closed and is at the lowest position to the second maximum rotation position in the second rotation direction within a range of the second maximum rotation angle and rotates with the rotation radius almost identical to the rotation radius of the first rotary winding member, independently of the first rotary winding member.

The second coupling member alone is wound up by the second amount (an amount smaller than the first amount) by the second rotary winding member, and the discharge valve is pulled up by the second amount. This causes the second flush water amount (a flush water amount smaller than the first flush water amount) of flush water to be supplied from the flush water tank device to the toilet to execute the toilet flushing in the second flush mode.

Thus, either one of the first rotary winding member and the second rotary winding member can be independently rotated with the rotation radius almost identical to the rotation radius of the other in accordance with each operation mode of the operation device. Additionally, since the first maximum rotation angle of the first rotary winding member is set larger than the second maximum rotation angle of the second rotary winding member, each of the first rotary winding member and the second rotary winding member can be simply structured.

The first rotary winding member and the second rotary winding member can operate smoothly while suppressing interference with each other.

The first coupling member and the second coupling member coupled to the first rotary winding member and the second rotary winding member, respectively, can operate smoothly while suppressing interference with each other.

Thus, since switching operation between the first operation mode and the second operation mode that are different operation modes of the operation device can be accurately and smoothly performed, valve opening operation corresponding to each flush mode of the discharge valve can be accurately performed.

According to the present invention, preferably, the discharge valve operating device further includes a biasing member which is provided to the first rotary winding member and the second rotary winding member, the biasing member being configured to be capable of biasing the first rotary winding member at the first maximum rotation position and the second rotary winding member at the second maximum rotation position such that the first rotary winding member and the second rotary winding member return to the initial position.

According to the present invention configured in the above-described manner, a biasing force of the biasing member provided to the first rotary winding member and the second rotary winding member allows each of the first rotary winding member at the first maximum rotation position and the second rotary winding member at the second maximum rotation position to return to the initial position.

Thus, the first rotary winding member after an exit from the first operation mode and the second rotary winding member after an exit from the second operation mode can be reliably and swiftly returned to the initial position in preparation for next toilet flush operation (valve opening operation of the discharge valve). It is also possible to accurately perform rotational operation of the first rotary winding member or the second rotary winding member corresponding to a next flush mode.

According to the present invention, preferably, the biasing member is a torsion coil spring which is provided on a central axis almost identical to central axes of the first rotary winding member and the second rotary winding member, the torsion coil spring including a first arm portion and a second arm portion extending outward from one end and the other end, respectively, of the torsion coil spring, the first rotary winding member includes a first arm mounting portion, to which one of the first arm portion and the second arm portion is mounted, the second rotary winding member includes a second arm mounting portion, to which the other of the first arm portion and the second arm portion is mounted, the first arm portion of the torsion coil spring is configured to bias the first arm mounting portion of the first rotary winding member at the first maximum rotation position in the second rotation direction and return the first rotary winding member to the initial position, and the second arm portion of the torsion coil spring is configured to bias the second arm mounting portion of the second rotary winding member at the second maximum rotation position in the first rotation direction and return the second rotary winding member to the initial position.

According to the present invention configured in the above-described manner, the first arm portion of the torsion coil spring biases the first arm mounting portion of the first rotary winding member at the first maximum rotation position in the second rotation direction in the first operation mode. This allows the first rotary winding member to return more reliably and swiftly to the initial position.

Similarly, the second arm portion of the torsion coil spring biases the second arm mounting portion of the second rotary winding member at the second maximum rotation position in the first rotation direction in the second operation mode. This allows the second rotary winding member to return more reliably and swiftly to the initial position.

Thus, the first rotary winding member after an exit from the first operation mode and the second rotary winding member after an exit from the second operation mode can be more reliably and swiftly returned to the initial position in preparation for next toilet flush operation (valve opening operation of the discharge valve). It is also possible to accurately perform rotational operation associated with the first rotary winding member or the second rotary winding member corresponding to a next flush mode.

According to the present invention, preferably, the rotating shaft includes a rotating shaft body portion which extends in an axial direction of the rotating shaft and a projecting portion which protrudes outward from a part of an outer peripheral surface of the rotating shaft body portion, the projecting portion including a first projection side surface which is formed on a side facing the first rotation direction and a second projection side surface which is formed on a side facing the second rotation direction of the first projection side surface, and the first holed portion of the first rotary winding member and the second holed portion of the second rotary winding member are formed near the portions at the respective rotation centers of the first rotary winding member and the second rotary winding member such that the rotating shaft is insertable in the axial direction and include a first engagement-avoidance region and a second engagement-avoidance region, respectively, where engagement with the projecting portion of the rotating shaft is avoidable in accordance with the rotation direction of the rotating shaft.

According to the present invention configured in the above-described manner, the first holed portion of the first rotary winding member and the second holed portion of the second rotary winding member are formed near the portions at the respective rotation centers of the first rotary winding member and the second rotary winding member such that the rotating shaft is insertable in the axial direction and include the first engagement-avoidance region and the second engagement-avoidance region, respectively, where engagement with the projecting portion of the rotating shaft is avoidable in accordance with the rotation direction of the rotating shaft. With the engagement-avoidance regions, it is possible in each operation mode of the operation device to efficiently and independently rotate either one of the first rotary winding member and the second rotary winding member, together with the rotating shaft, in accordance with the operation mode while suppressing mutual interference between the first rotary winding member and the second rotary winding member.

Thus, in each operation mode of the operation device, either one of the first rotary winding member and the second rotary winding member can operate independently and smoothly while suppressing interference with the other rotary winding member. This allows improvement in the operability of the discharge valve operating device corresponding to each operation mode.

According to the present invention, preferably, the first holed portion of the first rotary winding member includes a first hole side surface which engages with the first projection side surface of the rotating shaft at the initial position and a second hole side surface which is separated from the first hole side surface in the second rotation direction, the second holed portion of the second rotary winding member includes a third hole side surface which engages with the second projection side surface of the rotating shaft at the initial position and a fourth hole side surface which is separated from the third hole side surface in the first rotation direction, in the first engagement-avoidance region, engagement between the second projection side surface of the projecting portion in the rotating shaft and the second hole side surface of the first holed portion in the first rotary winding member is avoidable when the rotating shaft is located between the initial position and the second maximum rotation position, and in the second engagement-avoidance region, engagement between the first projection side surface of the projecting portion in the rotating shaft and the fourth hole side surface of the second holed portion in the second rotary winding member is avoidable when the rotating shaft is located between the initial position and the first maximum rotation position.

According to the present invention configured in the above-described manner, when the rotating shaft is located between the initial position and the second maximum rotation position, the first engagement-avoidance region of the first holed portion in the first rotary winding member can avoid engagement between the second projection side surface of the projecting portion in the rotating shaft and the second hole side surface of the first holed portion in the first rotary winding member with a simple structure.

On the other hand, when the rotating shaft is located between the initial position and the first maximum rotation position, the second engagement-avoidance region of the second holed portion in the second rotary winding member can avoid engagement between the first projection side surface of the projecting portion in the rotating shaft and the fourth hole side surface of the second holed portion in the second rotary winding member with a simple structure.

According to the present invention, preferably, if the rotating shaft is rotated from the initial position in the first rotation direction in the first operation mode of the operation device, the first hole side surface of the first holed portion in the first rotary winding member and the first projection side surface of the rotating shaft are kept in engagement with each other in the first engagement-avoidance region, and the third hole side surface of the second holed portion in the second rotary winding member and the second projection side surface of the rotating shaft are brought out of engagement with each other in the second engagement-avoidance region, and if the rotating shaft is rotated from the initial position in the second rotation direction in the second operation mode of the operation device, the third hole side surface of the second holed portion in the second rotary winding member and the second projection side surface of the rotating shaft are kept in engagement with each other in the second engagement-avoidance region, and the first hole side surface of the first holed portion in the first rotary winding member and the first projection side surface of the rotating shaft are brought out of engagement with each other in the first engagement-avoidance region.

According to the present invention configured in the above-described manner, if the rotating shaft is rotated from the initial position in the first rotation direction in the first operation mode of the operation device, the first hole side surface of the first holed portion in the first rotary winding member and the first projection side surface of the rotating shaft are kept in engagement with each other in the first engagement-avoidance region. At this time, the third hole side surface of the second holed portion in the second rotary winding member and the second projection side surface of the rotating shaft are brought out of engagement with each other in the second engagement-avoidance region.

If the rotating shaft is rotated from the initial position in the second rotation direction in the second operation mode of the operation device, the third hole side surface of the second holed portion in the second rotary winding member and the second projection side surface of the rotating shaft are kept in engagement with each other in the second engagement-avoidance region. At this time, the first hole side surface of the first holed portion in the first rotary winding member and the first projection side surface of the rotating shaft are brought out of engagement with each other in the first engagement-avoidance region.

As a result, it is possible in each operation mode of the operation device to efficiently and independently rotate either one of the first rotary winding member and the second rotary winding member, together with the rotating shaft, in accordance with the operation mode, while suppressing mutual interference between the first rotary winding member and the second rotary winding member.

Thus, in each operation mode of the operation device, either one of the first rotary winding member and the second rotary winding member can operate independently and smoothly while suppressing interference with the other. This allows improvement in the operability of the discharge valve operating device corresponding to each operation mode.

Toilet flushing in each of the first flush mode and the second flush mode that are different flush modes can be accurately executed.

According to the present invention, preferably, the first rotary winding member and the second rotary winding member include a first mounting portion and a second mounting portion, respectively, to which the respective other ends of the first coupling member and the second coupling member are mountable, at respective outer peripheries, the mounting portions being arranged on a line almost parallel to directions of respective rotation central axes of the first rotary winding member and the second rotary winding member at the initial position, the first coupling member and the second coupling member are arranged symmetrically on one side and the other side of the rotation centers of the first rotary winding member and the second rotary winding member in elevation view, and at the initial position, the first mounting portion of the first rotary winding member and the other end of the first coupling member are set at a position where the first coupling member is wound up in advance in the first rotation direction along the outer periphery of the first rotary winding member by a predetermined length, and the second mounting portion of the second rotary winding member and the other end of the second coupling member are set at a position where the second coupling member is wound up in advance in the second rotation direction along the outer periphery of the second rotary winding member by the predetermined length.

According to the present invention configured in the above-described manner, the first mounting portion of the first rotary winding member and the second mounting portion of the second rotary winding member are arranged on the line almost parallel to the directions of the rotation central axes of the first rotary winding member and the second rotary winding member. The first coupling member and the second coupling member are arranged symmetrically on the one side and the other side of the rotation centers of the first rotary winding member and the second rotary winding member in elevation view. Additionally, at the initial position, the first mounting portion of the first rotary winding member and the other end of the first coupling member are set at the position where the first coupling member is wound up in advance in the first rotation direction along the outer periphery of the first rotary winding member by the predetermined length, and the second mounting portion of the second rotary winding member and the other end of the second coupling member are set at the position where the second coupling member is wound up in advance in the second rotation direction along the outer periphery of the second rotary winding member by the predetermined length.

With the above-described configurations, even when either one of the first rotary winding member and the second rotary winding member rotates independently in accordance with each flush mode, either one of the first coupling member and the second coupling member can move reliably and smoothly without interference with the other.

According to the present invention, preferably, the discharge valve operating device further includes a holding portion which rotatably holds the first rotary winding member and the second rotary winding member, and the holding portion includes a rotation angle limiting portion which is capable of limiting a range of a rotation angle between the initial position and the first maximum rotation position of the first rotary winding member and limiting a range of a rotation angle between the initial position and the second maximum rotation position of the second rotary winding member.

According to the present invention configured in the above-described manner, the holding portion that rotatably holds the first rotary winding member and the second rotary winding member can limit the range of the rotation angle between the initial position and the first maximum rotation position of the first rotary winding member and limit the range of the rotation angle between the initial position and the second maximum rotation position of the second rotary winding member.

Thus, rotational operation of either one of the first rotary winding member and the second rotary winding member corresponding to each flush mode can be accurately performed. It is possible to accurately manage a pull-up amount for the discharge valve at the time of valve opening operation corresponding to each flush mode.

According to the present invention, preferably, the first rotary winding member includes a first engaging portion which is engageable with the rotation angle limiting portion of the holding portion at the initial position and a second engaging portion which is engageable with the rotation angle limiting portion at the first maximum rotation position, and the second rotary winding member includes a third engaging portion which is engageable with the rotation angle limiting portion of the holding portion at the initial position and a fourth engaging portion which is engageable with the rotation angle limiting portion at the second maximum rotation position.

According to the present invention configured in the above-described manner, when the first rotary winding member is located at the initial position, the first engaging portion of the first rotary winding member can engage with the rotation angle limiting portion of the holding portion, and when the first rotary winding member is located at the first maximum rotation position, the second engaging portion of the first rotary winding member can engage with the rotation angle limiting portion of the holding portion.

When the second rotary winding member is located at the initial position, the third engaging portion of the second rotary winding member can engage with the rotation angle limiting portion of the holding portion, and when the second rotary winding member is located at the second maximum rotation position, the fourth engaging portion of the second rotary winding member can engage with the rotation angle limiting portion of the holding portion.

It is thus possible to reliably limit the range of the rotation angle between the initial position and the first maximum rotation position of the first rotary winding member and reliably limit the range of the rotation angle between the initial position and the second maximum rotation position of the second rotary winding member.

Since rotational operation of either one of the first rotary winding member and the second rotary winding member corresponding to each flush mode can be more accurately performed, a pull-up amount for the discharge valve at the time of valve opening operation corresponding to each flush mode can be more accurately managed.

According to the present invention, preferably, the one end of the first coupling member is engageably/disengageably coupled to a first coupling portion of the discharge valve, and the one end of the second coupling member is engageably/disengageably coupled to a second coupling portion which is adjacent to the first coupling portion of the discharge valve.

According to the present invention configured in the above-described manner, when the rotating shaft and the first rotary winding member are rotated from the initial position in the first rotation direction in the first operation mode of the operation device, since the first coupling member alone is wound up by the first amount by the first rotary winding member, the first coupling portion of the discharge valve is pulled up in a state of being engaged with the one end of the first coupling member.

At this time, since the second rotary winding member is stationary, and the second coupling member is not wound up, the second coupling portion of the discharge valve is pulled up together with the first coupling portion of the discharge valve and the first coupling member in a state of being out of engagement with the one end of the second coupling member and slides and moves upward with respect to the one end of the second coupling member.

When the rotating shaft and the second rotary winding member are rotated from the initial position in the second rotation direction in the second operation mode of the operation device, since the second coupling member alone is wound up by the second amount by the second rotary winding member, the second coupling portion of the discharge valve is pulled up in a state of being engaged with the one end of the second coupling member.

At this time, since the first rotary winding member is stationary, and the first coupling member is not wound up, the first coupling portion of the discharge valve is pulled up together with the second coupling portion of the discharge valve and the second coupling member in a state of being out of engagement with the one end of the first coupling member and slides and moves upward with respect to the one end of the first coupling member.

As a result, it is possible to suppress mutual interference between the first coupling member and the second coupling member during valve opening operation of the discharge valve corresponding to each flush mode. It is also possible to suppress mutual interference between the first and second coupling members and an associated structural portion surrounding the first coupling member and the second coupling member.

Thus, the valve opening operation of the discharge valve corresponding to each flush mode can be accurately performed, a flush water amount of flush water corresponding to each of the first flush mode and the second flush mode that are different flush modes can be accurately supplied from the flush water tank device to the toilet, and toilet flushing can be accurately executed.

According to the present invention, preferably, the discharge valve operating device further includes a manual operation device which is capable of the valve opening operation of the discharge valve through manual press operation.

According to the present invention configured in the above-described manner, the valve opening operation of the discharge valve can be performed not only through electric operation by the electric operation device but also through manual press operation of the manual operation device.

Thus, at the time of execution of toilet flushing, one of electric operation by the electric operation device and manual press operation of the manual operation device can be properly selected and used in accordance with a user's preference.

Even if the need for maintenance or a problem arises in the electric operation unit or trouble, such as a power failure, occurs, the valve opening operation of the discharge valve can be reliably performed through manual press operation of the manual operation device.

According to the present invention, there is provided a flush water tank device including the above-described discharge valve operating device.

According to the present invention configured in the above-described manner, a flush water amount of flush water corresponding to each of the first flush mode and the second flush mode that are different flush modes can be accurately supplied from the flush water tank device to the toilet through the valve opening operation of the discharge valve by the discharge valve operating device.

Thus, a flush water tank device capable of accurately executing toilet flushing can be provided.

According to the present invention, there is provided a flush toilet including the above-described flush water tank device.

According to the present invention configured in the above-described manner, a flush water amount of flush water corresponding to each of the first flush mode and the second flush mode that are different flush modes can be accurately supplied from the flush water tank device to the toilet through the valve opening operation of the discharge valve by the discharge valve operating device.

Thus, a flush toilet capable of accurately executing toilet flushing can be provided.

The discharge valve operating device, the flush water tank device, and the flush toilet according to the present invention can improve the operability of valve opening operation of a discharge valve and accurately execute toilet flushing in accordance with a plurality of flush modes.

DETAILED DESCRIPTION OF THE PREFERRED EMBODIMENTS

A discharge valve operating device according to a first embodiment of the present invention will be described below with reference to the accompanying drawings.

Figure 1:
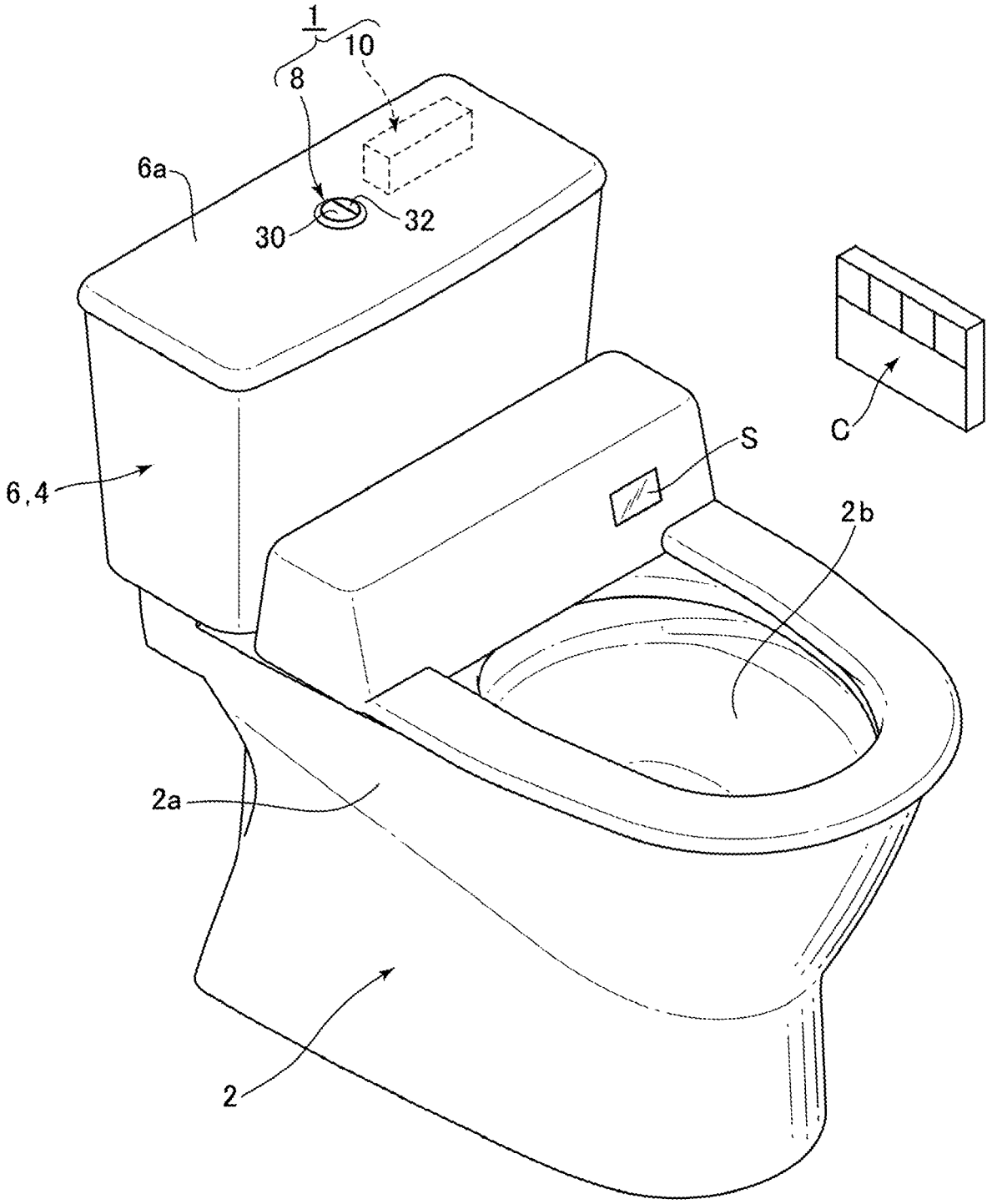
FIG. 1 is a schematic perspective view illustrating a flush toilet including a flush water tank device, to which a discharge valve operating device according to a first embodiment of the present invention is applied.

FIG. 1 is a schematic perspective view illustrating a flush toilet including a flush water tank device, to which the discharge valve operating device according to the first embodiment of the present invention is applied.

As illustrated in FIG. 1, a discharge valve operating device 1 according to the first embodiment of the present invention is provided in a flush water tank device 4 which supplies flush water to a flush toilet 2.

The flush water tank device 4 includes a water storage tank 6 which is mounted to an upper surface and on a rear side of a toilet body 2*a* of the flush toilet 2. The water storage tank 6 is a so-called gravity water supply type water storage tank which supplies flush water to the flush toilet 2 by using gravity for the flush water stored inside the water storage tank 6.

Note that, in the present embodiment, the flush toilet 2 may be applied to a so-called wash-down type toilet in which flush water supplied from the flush water tank device 4 discharges excrement by a drop in a height direction of a bowl 2*b* in the toilet body 2*a* or can be applied to flush toilets in various forms, such as a so-called siphon type toilet which sucks excrement in the bowl 2*b* and discharges the excrement at once from a drain trap conduit (not illustrated) by means of a siphon action.

Figure 2:
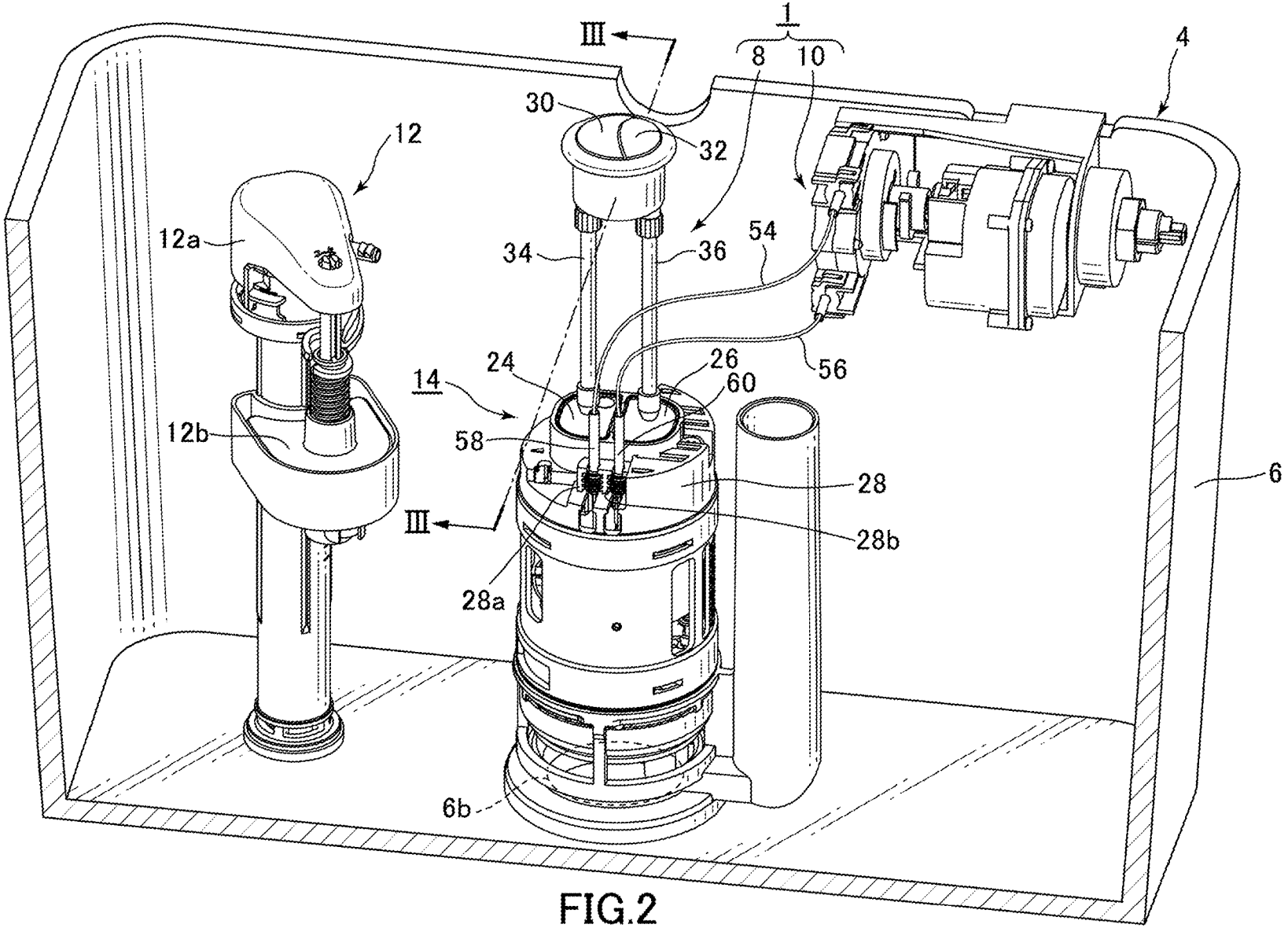
FIG. 2 is a schematic perspective view of an internal structure of the flush water tank device, to which the discharge valve operating device according to the first embodiment of the present invention is applied, as viewed obliquely from the front and above.

FIG. 2 is a schematic perspective view of an internal structure of the flush water tank device, to which the discharge valve operating device according to the first embodiment of the present invention is applied, as viewed obliquely from the front and above.

As illustrated in FIGS. 1 and 2, the discharge valve operating device 1 according to the present embodiment includes a manual operation unit 8 and an electric operation unit 10.

As illustrated in FIGS. 1 and 2, the manual operation unit 8 is provided at a tank lid 6*a* at an upper portion of the water storage tank 6. Although details will be described later, the electric operation unit 10 is mounted to an upper portion of a rear wall surface inside the water storage tank 6.

As illustrated in FIG. 2, a water supply valve device 12 and a discharge valve device 14 are further provided inside the water storage tank 6.

As illustrated in FIG. 2, the water supply valve device 12 includes a water supply pipe (not illustrated), a water supply valve 12*a*, a float 12*b*, and the like. The water supply pipe (not illustrated) is connected to a water supply source (not illustrated) outside the water storage tank 6, such as the city waterworks.

The water supply valve 12*a* opens and closes a flow path to the water supply pipe (not illustrated), and the float 12*b* moves up and down in accordance with a variation of a water level in the water storage tank 6. With the upward and downward movement of the float 12*b*, the water supply valve 12*a* opens and closes the flow path to the water supply path (not illustrated), which allows switching between delivery and stop of water into the water storage tank 6.

Note that details of the water supply valve device 12 are similar to those of a conventional water supply valve device and that a description thereof will be omitted.

Figure 3:
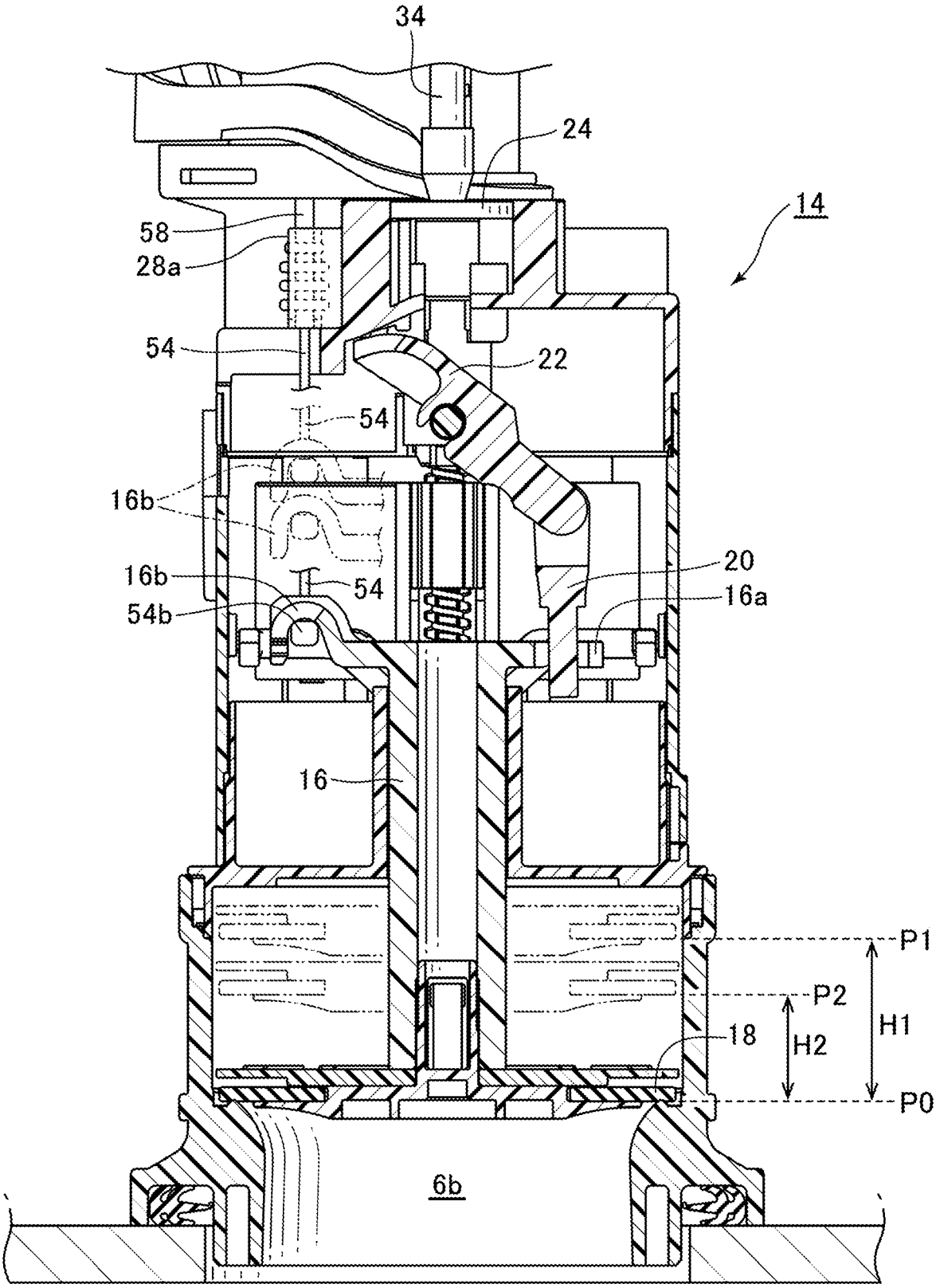
FIG. 3 is a sectional view taken along line in FIG. 2 and is a central side sectional view of a discharge valve device in the flush water tank device, to which the discharge valve operating device according to the first embodiment of the present invention is applied.

FIG. 3 is a sectional view taken along line in FIG. 2 and is a central side sectional view of a discharge valve device in the flush water tank device, to which the discharge valve operating device according to the first embodiment of the present invention is applied.

As illustrated in FIGS. 2 and 3, the discharge valve device 14 includes a spindle member 16 which extends in a vertical direction, a discharge valve body 18, a lower linking member 20, an upper linking member 22, a pressure-receiving member 24 for a full-flush mode, and a pressure-receiving member 26 for a partial-flush mode.

The discharge valve body 18 is provided at a lower end of the spindle member 16 and functions as a discharge valve which opens and closes a discharge port 6*b* in a bottom portion of the water storage tank 6 by moving up and down together with the spindle member 16.

At the time of staring toilet flushing, pull-up operation (valve opening operation) of the discharge valve body 18 can be performed by either one of manual operation of the manual operation unit 8 or electric operation by the electric operation unit 10 (details will be described later).

As illustrated in FIG. 3, in a state where the discharge valve body 18 is opened, flush water in the water storage tank 6 flows through the discharge port 6*b* into a conduit (not illustrated) of the toilet body 2*a* below (on a downstream side of) the discharge port 6*b*.

As illustrated in FIG. 3, the lower linking member 20 of the discharge valve device 14 is mounted to a mounting portion 16*a* for manual operation which protrudes outward from an upper end portion of the spindle member 16, and one end portion of the upper linking member 22 is pivotably coupled to an upper end portion of the lower linking member 20.

As illustrated in FIGS. 2 and 3, the pressure-receiving members 24 and 26 are mounted to an upper end portion of a casing 28 in the discharge valve device 14 so as to be slidable in the vertical direction, and the common upper linking member 22 is swingably coupled to the pressure-receiving members 24 and 26.

As illustrated in FIGS. 2 and 3, the manual operation unit 8 of the discharge valve operating device 1 according to the first embodiment of the present invention is a so-called operation button type manual operation unit and includes an operation button 30 for the full-flush mode and an operation button 32 for the partial-flush mode, push-down operation (press operation) of which can be manually performed, and an operation bar 34 for the full-flush mode and an operation bar 36 for the partial-flush mode which extend downward from the respective operation buttons 30 and 32.

As illustrated in FIGS. 2 and 3, respective lower ends of the operation bars 34 and 36 in the manual operation unit 8 are constantly in contact with respective upper end faces (pressure-receiving surfaces) of the pressure-receiving members 24 and 26 in the discharge valve device 14.

Note that, for example, when manual operation for the full-flush mode is to be performed with the manual operation unit 8, as illustrated in FIGS. 2 and 3, the operation button 30 for the full-flush mode is pushed down by a push-in amount larger than a push-in amount for the operation button 32 for the partial-flush mode. In conjugation with this operation, the operation bar 34 for the full-flush mode and the pressure-receiving member 24 for the full-flush mode move downward. This swings the common upper linking member 22 by a swing angle larger than a swing angle at the time of operation in the partial-flush mode and pulls up the lower linking member 20 by a pull-up amount larger than a pull-up amount at the time of operation in the partial-flush mode. The discharge valve body 18 of the discharge valve device 14, together with the spindle member 16, is pulled up from a closed valve position (an initial position) P0 to a highest opened valve position P1 for the full-flush mode by a maximum pull-up amount H1 [mm].

On the other hand, when manual operation for the partial-flush mode is to be performed with the manual operation unit 8, as illustrated in FIGS. 2 and 3, the operation button 32 for the partial-flush mode is pushed down by the push-in amount smaller than that for the operation button 30 for the full-flush mode. In this state, further downward movement of the operation button 32 is limited. The operation bar 36 for the partial-flush mode and the pressure-receiving member 26 for the partial-flush mode move downward in conjugation with the push but stop at positions higher than positions for the operation bar 34 for the full-flush mode and the pressure-receiving member 24 for the full-flush mode.

The downward movement swings the common upper linking member 22 by the swing angle smaller than the swing angle at the time of operation in the full-flush mode and pulls up the lower linking member 20 by the pull-up amount smaller than that at the time of operation in the full-flush mode. The discharge valve body 18 of the discharge valve device 14, together with the spindle member 16, is pulled up from the closed valve position P0 to a highest opened valve position P2 for the partial-flush mode by a maximum pull-up amount H2 [mm] (H2<H1) smaller than the pull-up amount H1 [mm] at the time of operation in the full-flush mode.

Details of the electric operation unit 10 of the discharge valve operating device 1 according to the first embodiment of the present invention will be described with reference to FIGS. 2 to 10(A) to 10(C).

Figure 4:
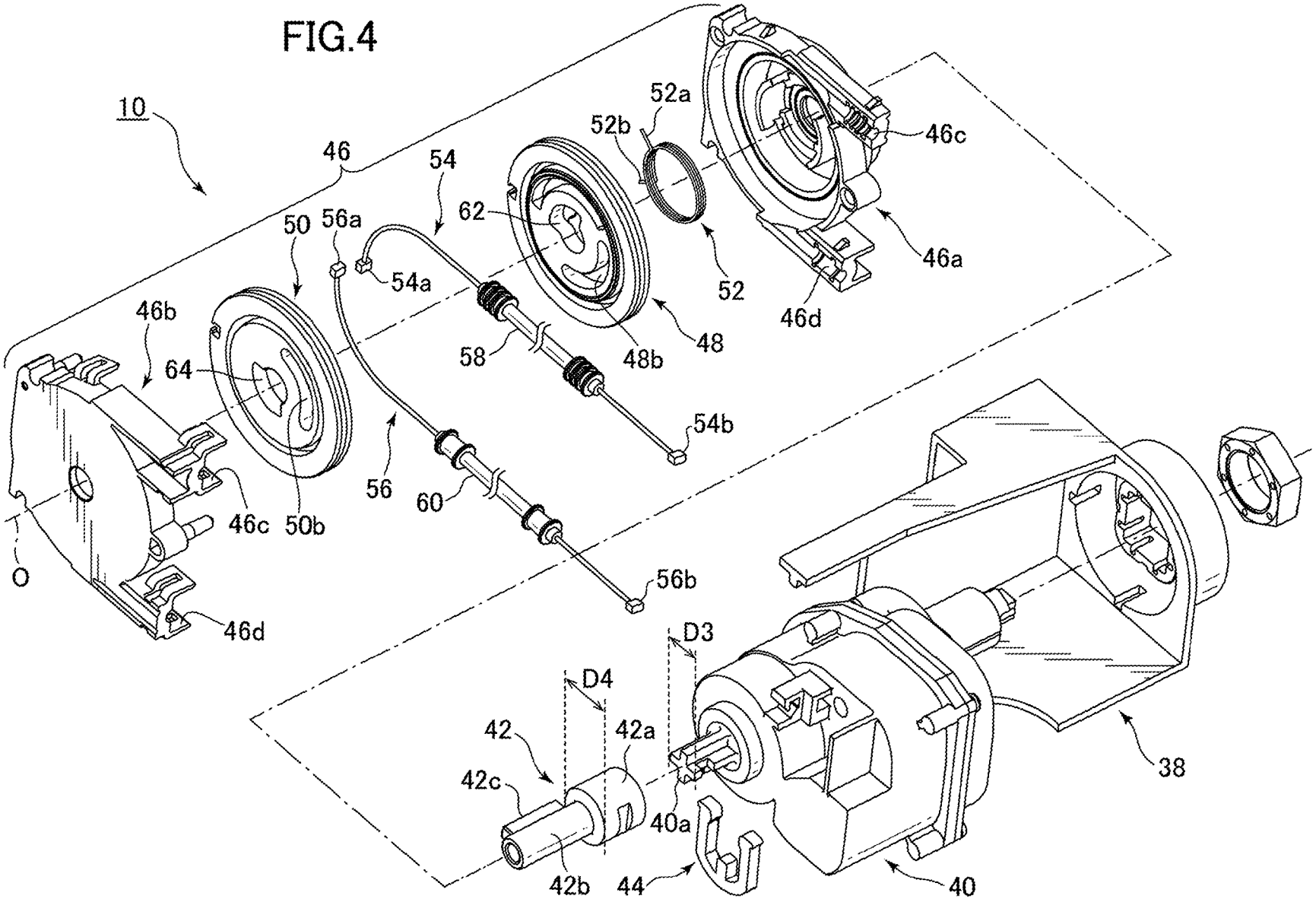
FIG. 4 is an exploded perspective view of an electric operation unit of the discharge valve operating device according to the first embodiment of the present invention, as viewed obliquely from the front and above on the left.

FIG. 4 is an exploded perspective view of an electric operation unit of the discharge valve operating device according to the first embodiment of the present invention, as viewed obliquely from the front and above on the left.

Figure 5:
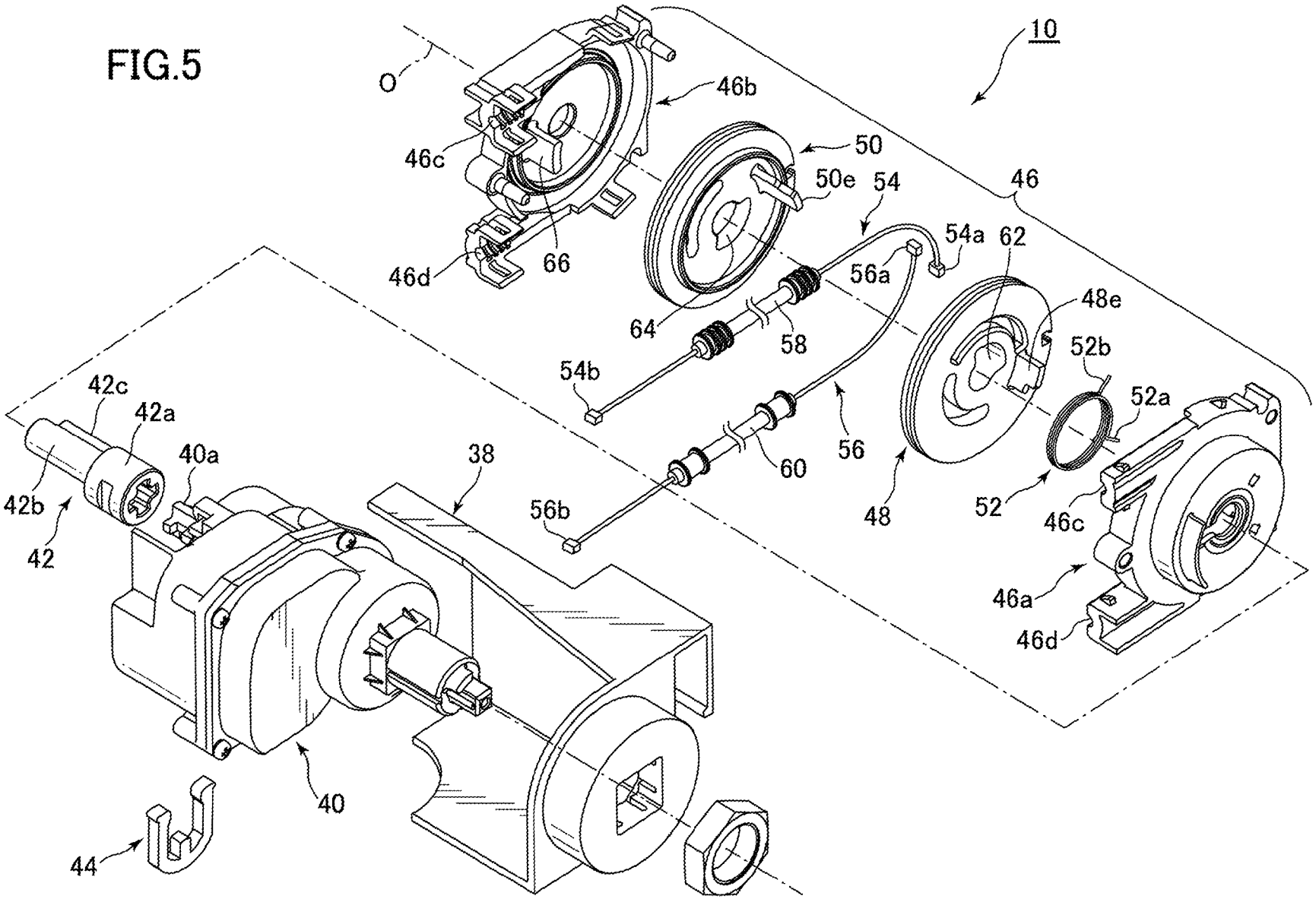
FIG. 5 is an exploded perspective view of the electric operation unit of the discharge valve operating device according to the first embodiment of the present invention, as viewed obliquely from the front and above on the right.

FIG. 5 is an exploded perspective view of the electric operation unit of the discharge valve operating device according to the first embodiment of the present invention, as viewed obliquely from the front and above on the right.

As illustrated in FIGS. 4 and 5, the electric operation unit 10 of the discharge valve operating device 1 according to the present embodiment includes a holder 38, an actuator 40, a rotating shaft member 42, a fastener 44, a casing 46, a first pulley 48 for operation in the full-flush mode (a first rotary winding member), a second pulley 50 for operation in the partial-flush mode (a second rotary winding member), a return spring 52 (a biasing member), a first electric wire 54 for operation in the full-flush mode (a first coupling member), and a second electric wire 56 for operation in the partial-flush mode (a second coupling member).

As illustrated in FIGS. 2, 4, and 5, the holder 38 of the electric operation unit 10 is mounted to the upper portion of the rear wall surface inside the water storage tank 6 to fix the whole electric operation unit 10 inside the water storage tank 6.

As illustrated in FIGS. 4 and 5, the actuator 40 of the electric operation unit 10 contains a gearbox (not illustrated) including a plurality of gears (not illustrated), a DC motor (not illustrated), and the like and is fixed inside the water storage tank 6 by the holder 38.

The actuator 40 is driven with electric power from the outside by the DC motor (not illustrated) and includes an electric rotating shaft 40*a* capable of being electrically rotationally driven.

As illustrated in FIGS. 4 and 5, the rotating shaft member 42 of the electric operation unit 10 is formed in the shape of a generally hollow or solid cylinder (details will be described later) and is coupled to a distal end portion of the electric rotating shaft 40*a* in the actuator 40.

The fastener 44 is externally mounted to a part of an outer peripheral surface of a base portion 42*a* on a proximal end side in an axial direction of the rotating shaft member 42. With the mounting, the rotating shaft member 42 is fixed to the electric rotating shaft 40*a* and is rotatable integrally with the electric rotating shaft 40*a*.

Note that, in electric operation by the electric operation unit 10, driving of the actuator 40 by the DC motor (not illustrated) or the like is controlled on the basis of, for example, a signal transmitted by a human sensor S (see FIG. 1) which is installed in surroundings of the flush toilet 2 after sensing and/or a signal transmitted when a user operates a predetermined operation button or the like of a command device C (see FIG. 1), such as a remote control or a controller, thereby controlling rotational driving of the electric rotating shaft 40*a*.

Note that although the present embodiment describes a form including both the human sensor S (see FIG. 1) and the command device C (see FIG. 1), either one may be omitted, and the electric rotating shaft 40*a* of the electric operation unit 10 may be actuated on the basis of a signal transmitted from the other alone.

Figure 6:
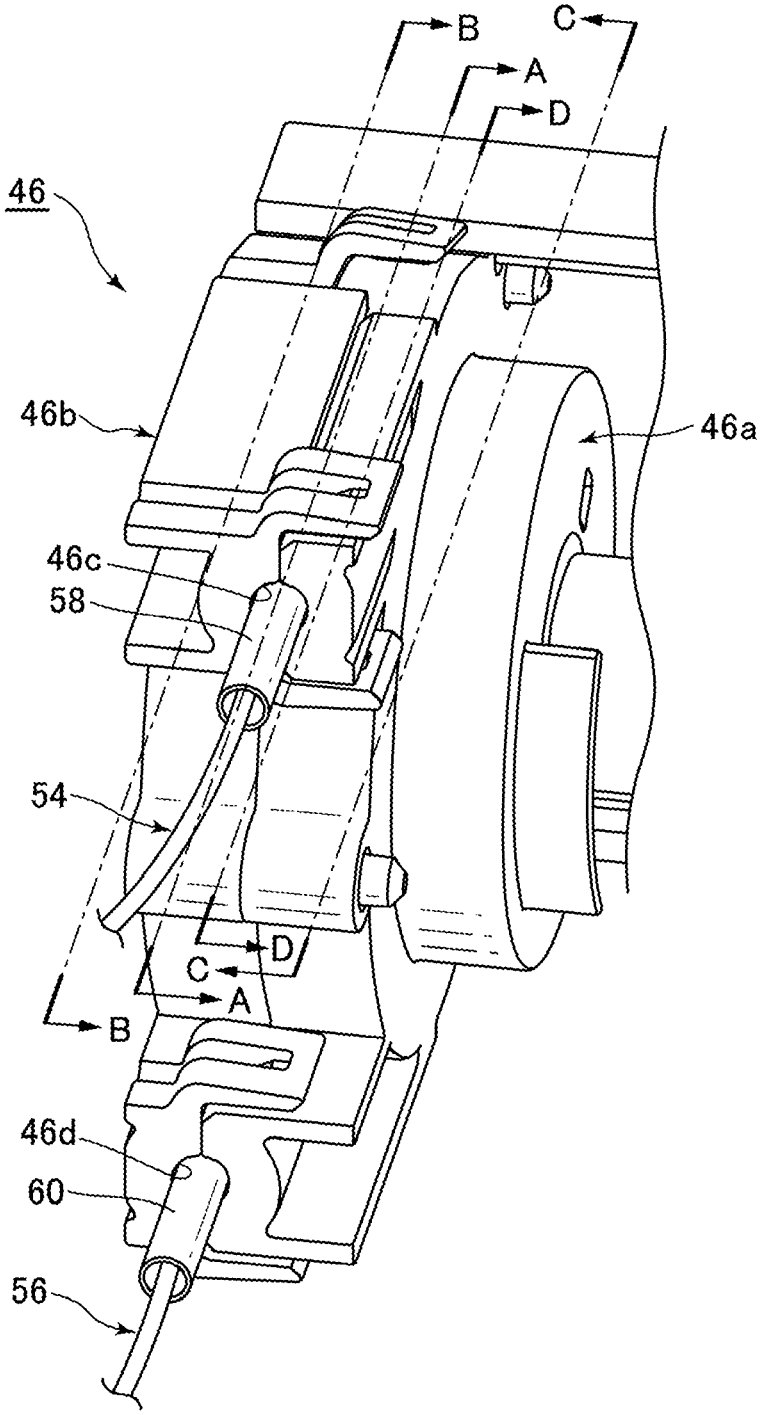
FIG. 6 is an enlarged perspective view of a casing portion of the electric operation unit of the discharge valve operating device according to the first embodiment of the present invention illustrated in FIG. 2.

FIG. 6 is an enlarged perspective view of a casing portion of the electric operation unit in the discharge valve operating device according to the first embodiment of the present invention illustrated in FIG. 2.

As illustrated in FIGS. 4 to 6, the casing 46 of the electric operation unit 10 includes a first casing 46*a* which is provided on the proximal end side in the axial direction of the rotating shaft member 42 and a second casing 46*b* which is provided on a distal end side in the axial direction of the rotating shaft member 42. The casing 46 is a holding portion which rotatably holds an outer peripheral surface of the rotating shaft member 42, and a part of the casing 46 is fixed by the holder 38 in a holding state.

As illustrated in FIGS. 4 and 5, the first pulley 48 and the second pulley 50 that are generally disk-shaped are rotatably housed in the casing 46 (between the first casing 46*a* and the second casing 46*b*).

Details of the first pulley 48 and the second pulley 50 will be described later. Either one of the pulleys 48 and 50, together with the rotating shaft member 42, rotates in accordance with each of operation modes (a full-flush operation mode or a partial-flush operation mode) when the electric operation unit 10 performs electric operation and is rotatable independently of the other of the pulleys 48 and 50.

As illustrated in FIGS. 4 and 5, the single return spring 52 is provided in the casing 46 (between the first casing 46*a* and the second casing 46*b*).

Details of the return spring 52 will also be described later. Parts of the return spring 52 are mounted to respective parts of the pulleys 48 and 50. With this configuration, the return spring 52 functions as a biasing member which biases either one of the first pulley 48 and the second pulley 50 such that the one returns to an initial position after electric operation corresponding to each flush mode by the electric operation unit 10 ends.

As illustrated in FIGS. 4 to 6, the first electric wire 54 and the second electric wire 56 of the electric operation unit 10 have respective one ends mounted to respective parts of the first pulley 48 and the second pulley 50.

As illustrated in FIG. 3, projections 54*b* and 56*b* at the other ends of the electric wires 54 and 56 are to be mounted to respective wire mounting portions (a first wire mounting portion 16*b* for full-flush operation and a second wire mounting portion 16*c* for partial-flush operation, details of which will be described later) which are provided at the upper end portion of the spindle member 16 in the discharge valve device 14.

As illustrated in FIGS. 4 to 6, respective outer sides of the wires 54 and 56 are protected by protective tubes 58 and 60, and the wires 54 and 56 are slidable inside the respective protective tubes 58 and 60.

Additionally, as illustrated in FIGS. 4 to 6, respective one ends of the protective tubes 58 and 60 are fixed to protective tube mounting portions 46*c* and 46*d*, respectively, of the casing 46 in the electric operation unit 10.

As illustrated in FIGS. 2 and 3, the other ends of the protective tubes 58 and 60 are fixed to protective tube mounting portions 28*a* and 28*b*, respectively, of the casing 28 in the discharge valve device 14.

Note that, as for the electric wires 54 and 56, when either one of the first electric wire 54 and the second electric wire 56 is wound up by the first pulley 48 or the second pulley 50 corresponding to the one when either one of the pulleys 48 and 50, together with the rotating shaft member 42, rotates in accordance with each operation mode (the full-flush operation mode or the partial-flush operation mode) when the electric operation unit 10 performs electric operation.

With the above-described operation, either one of the first electric wire 54 and the second electric wire 56 is pulled up, and the wire mounting portion 16*b* or 16*c* of the spindle member 16 in the discharge valve device 14 is pulled up.

Each of the rotating shaft member 42, the first pulley 48 for operation in the full-flush mode, the second pulley 50 for operation in the partial-flush mode, the return spring 52, the first electric wire 54 for operation in the full-flush mode, and the second electric wire 56 for operation in the partial-flush mode in the electric operation unit 10 will be described more specifically with reference to FIGS. 4 to 10(A) to 10(C).

FIGS. 7A to 7D are sectional views taken along line A-A, line B-B, line C-C, and line D-D, respectively, in FIG. 6 and illustrate an initial state (a standby state) before an entry into each flush operation mode in the electric operation unit of the discharge valve operating device according to the first embodiment of the present invention.

FIGS. 8A to 8D are sectional views taken along line A-A, line B-B, line C-C, and line D-D, respectively, in FIG. 6 and illustrate a state at the time of an exit from the full-flush operation mode in the electric operation unit of the discharge valve operating device according to the first embodiment of the present invention.

FIGS. 9A to 9D are sectional views taken along line A-A, line B-B, line C-C, and line D-D, respectively, in FIG. 6 and illustrate a state at the time of an exit from the partial-flush operation mode in the electric operation unit of the discharge valve operating device according to the first embodiment of the present invention.

As illustrated in FIGS. 4, 5, and 7A to 9D, the rotating shaft member 42 of the electric operation unit 10 includes a rotating shaft body portion 42*b* which extends toward the distal end side in the axial direction from the base portion 42*a* and a projecting portion 42*c* which protrudes outward from a part of an outer peripheral surface of the rotating shaft body portion 42*b*.

As illustrated in FIGS. 7A to 7D, in the rotating shaft member 42 at an initial position (a standby position) P0 before an entry into each operation mode in the electric operation unit 10, the projecting portion 42*c* is oriented in a horizontal direction.

As illustrated in FIGS. 7A to 8D, if rotational operation of the electric rotating shaft 40*a* is performed in a first operation mode (the full-flush operation mode) of the electric operation unit 10, the rotating shaft member 42 rotates about a rotation central axis O from the initial position (standby position) P0 illustrated in FIGS. 7A to 7D in a first rotation direction R1 and is rotatable to a first maximum rotation position P1 at a first maximum rotation angle θ1 illustrated in FIGS. 8A to 8D integrally with the electric rotating shaft 40*a*.

On the other hand, if rotational operation of the electric rotating shaft 40*a* is performed in a second operation mode (the partial-flush operation mode) of the electric operation unit 10, the rotating shaft member 42 rotates about the rotation central axis O from the initial position P0 illustrated in FIGS. 7A to 7D in a second rotation direction R2 (a rotation direction opposite to the first rotation direction R1) and is rotatable to a second maximum rotation position P2 at a second maximum rotation angle θ2 illustrated in FIGS. 9A to 9D integrally with the electric rotating shaft 40*a*.

As illustrated in FIGS. 7A to 9D, the projecting portion 42*c* of the rotating shaft member 42 includes a first projection side surface 42*d* which is formed on a side facing the first rotation direction R1 and further includes a second projection side surface 42*e* which is formed on a side facing the second rotation direction R2 of the first projection side surface 42*d*.

As illustrated in FIGS. 4, 5, 7A to 7C, 8A to 8C, and 9A to 9C, a first cut hole 62 (a first holed portion) and a second cut hole 64 (a second holed portion) are formed in respective central portions including the rotation central axis O and respective portions surrounding the central portions in the first pulley 48 and the second pulley 50.

As illustrated in FIGS. 7A to 7C, 8A to 8C, and 9A to 9C, the respective cut holes 62 and 64 of the pulleys 48 and 50 are each formed in a generally fan shape in elevation view, and the rotating shaft body portion 42*b* and the projecting portion 42*c* of the rotating shaft member 42 can be inserted in the axial direction.

As illustrated particularly in FIGS. 7A to 7C, 8A to 8C, and 9A to 9C, sectional shapes of the cut holes 62 and 64 are shapes obtained by enlarging a sectional shape of a combination of the rotating shaft body portion 42*b* and the projecting portion 42*c* of the rotating shaft member 42 in a circumferential direction.

For this reason, regions (a first engagement-avoidance region A1 and a second engagement-avoidance region A2) where engagement between either one of the cut holes 62 and 64 and the projecting portion 42*c* of the rotating shaft member 42 is avoidable when the projecting portion 42*c* of the rotating shaft member 42 rotates in the first rotation direction R1 or the second rotation direction R2 in accordance with a corresponding one of the flush operation modes of the electric operation unit 10 are formed in the respective cut holes 62 and 64, as illustrated in FIGS. 7A to 7C, 8A to 8C, and 9A to 9C.

Figure 7A:
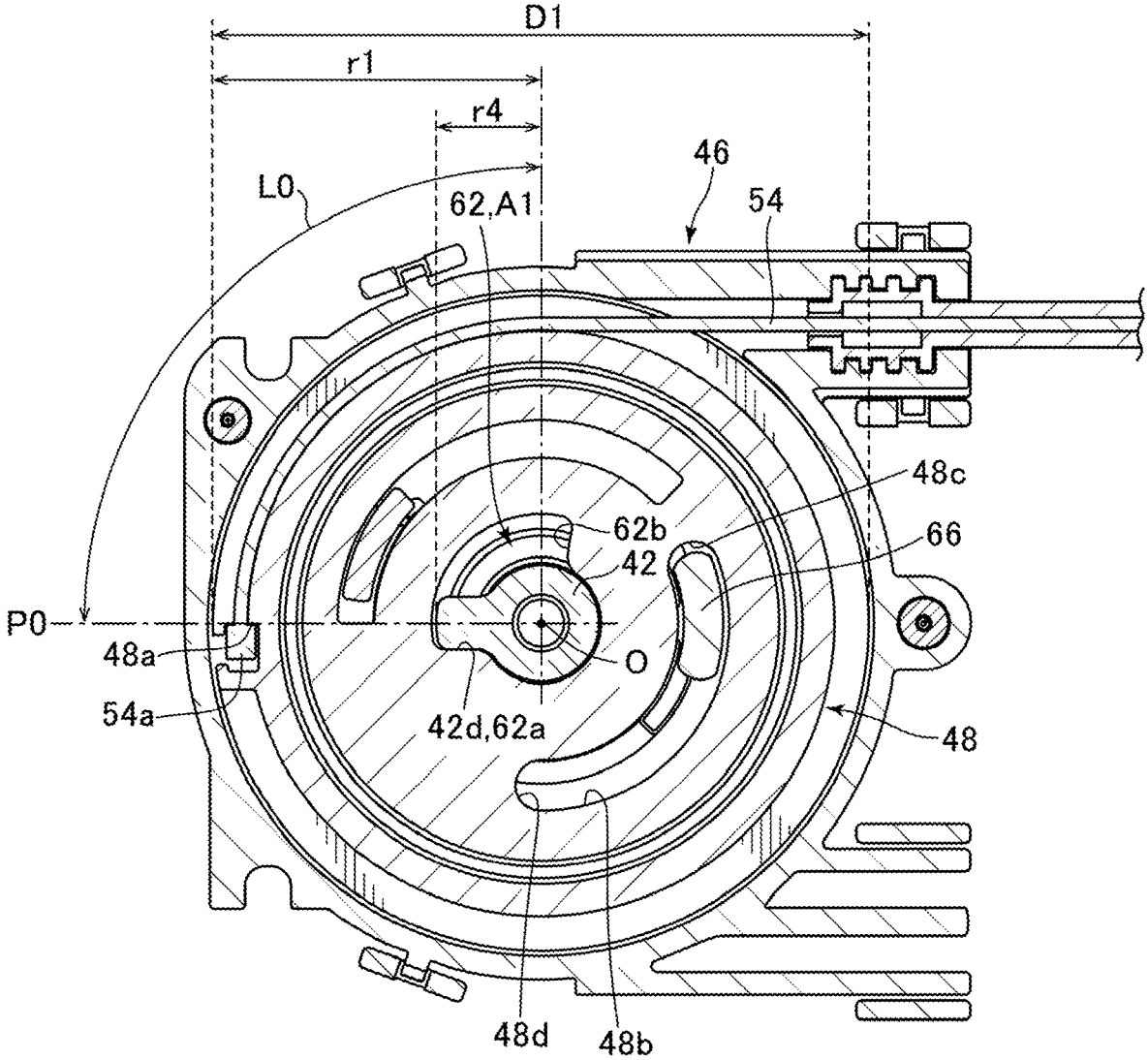
FIG. 7A is a sectional view taken along line A-A in FIG. 6 and illustrates an initial state (a standby state) before an entry into each of flush operation modes in the electric operation unit of the discharge valve operating device according to the first embodiment of the present invention.
Figure 7B:
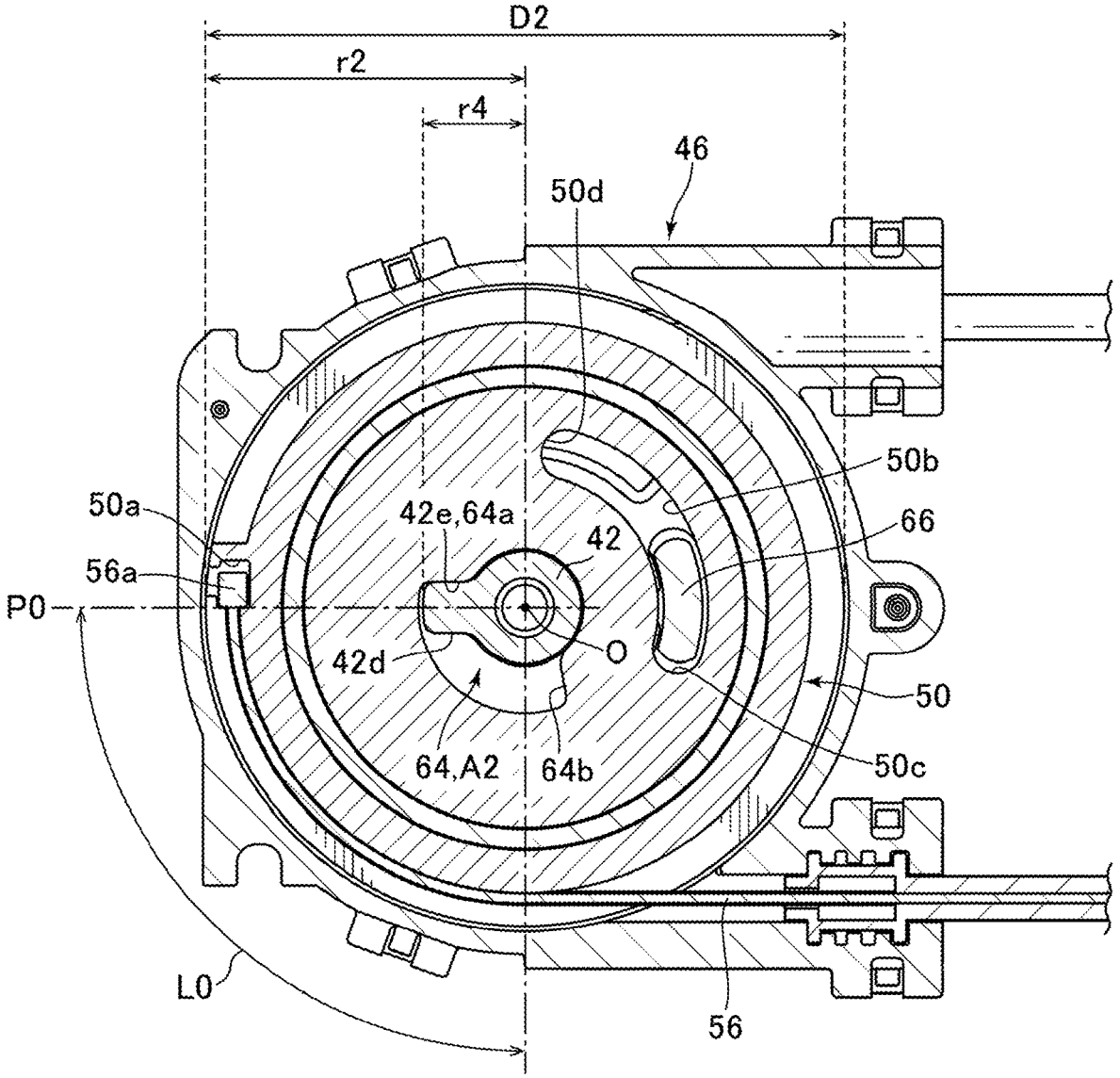
FIG. 7B is a sectional view taken along line B-B in FIG. 6 and illustrates the initial state (standby state) before the entry into each flush operation mode in the electric operation unit of the discharge valve operating device according to the first embodiment of the present invention.
Figure 7C:
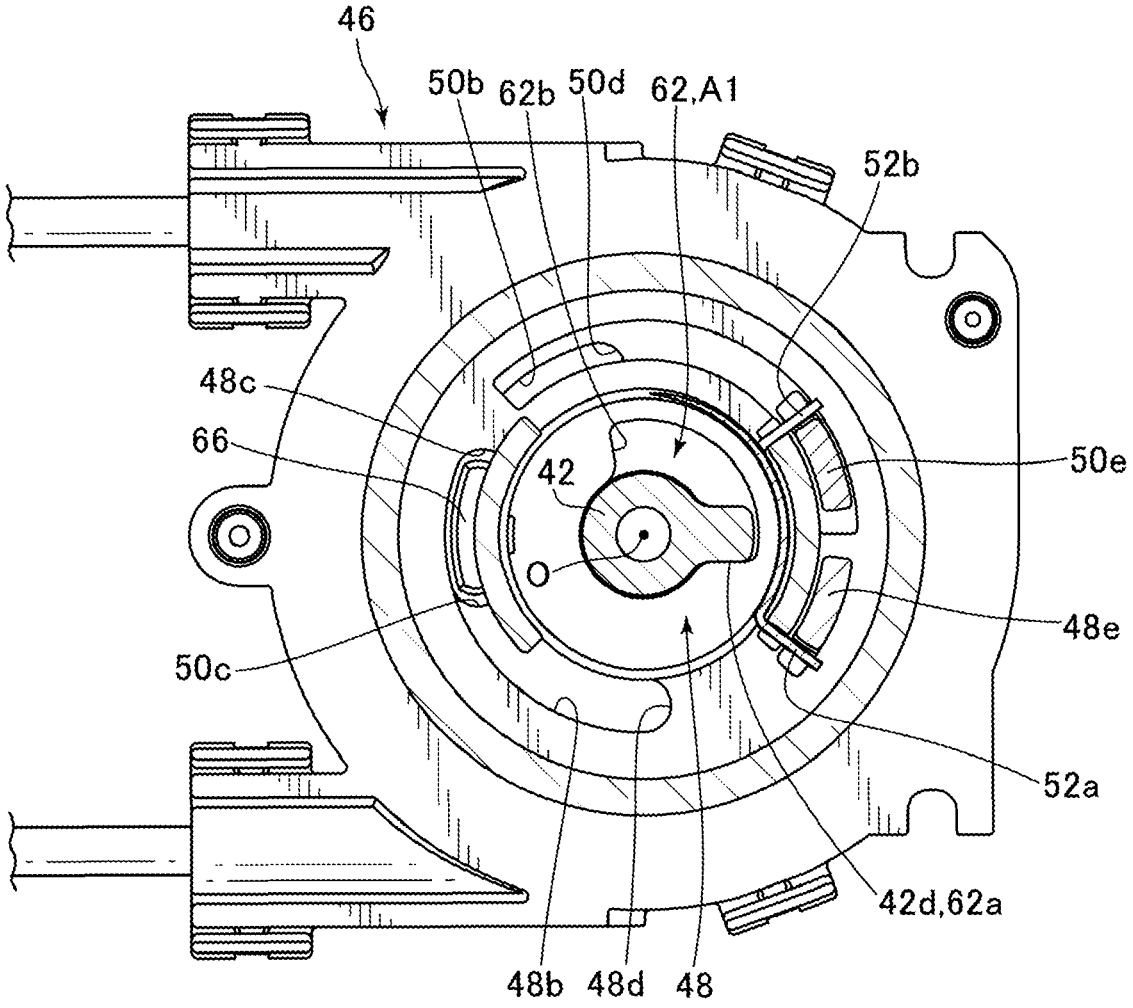
FIG. 7C is a sectional view taken along line C-C in FIG. 6 and illustrates the initial state (standby state) before the entry into each flush operation mode in the electric operation unit of the discharge valve operating device according to the first embodiment of the present invention.
Figure 7D:
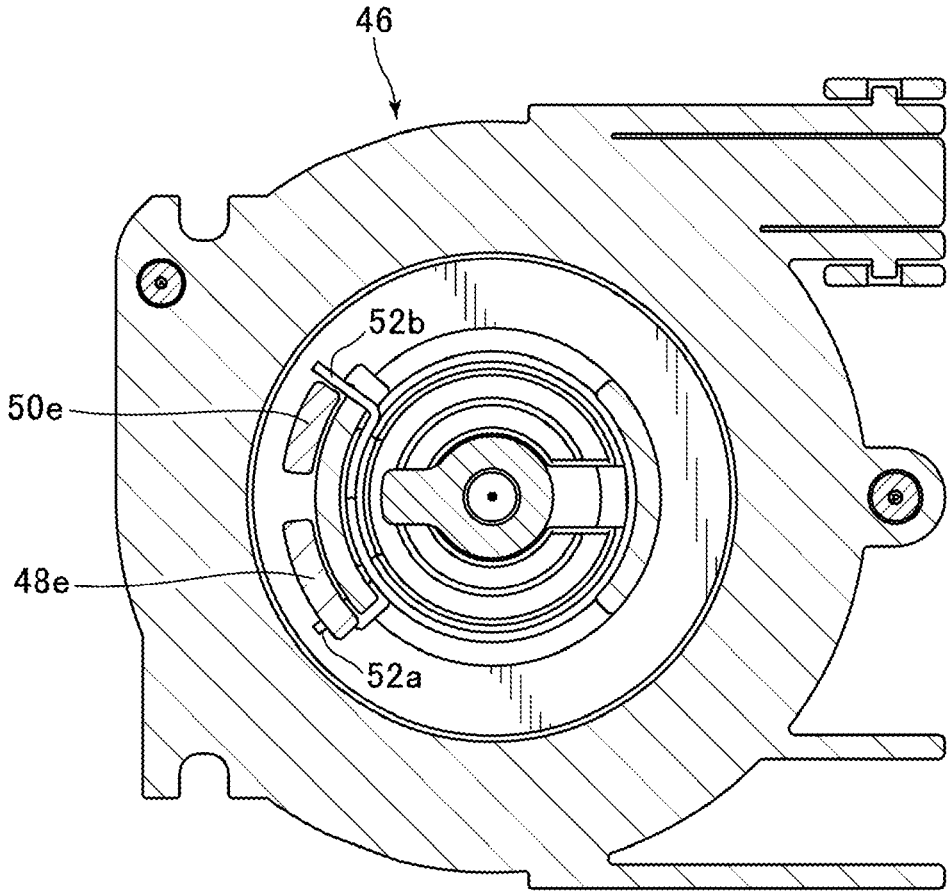
FIG. 7D is a sectional view taken along line D-D in FIG. 6 and illustrates the initial state (standby state) before the entry into each flush operation mode in the electric operation unit of the discharge valve operating device according to the first embodiment of the present invention.

As illustrated in FIGS. 7A to 7C, the first cut hole 62 of the first pulley 48 includes a first hole side surface 62*a* which engages with the first projection side surface 42*d* of the projecting portion 42*c* in the rotating shaft member 42 at the initial position P0 and further includes a second hole side surface 62*b* which is separated in the second rotation direction R2 from the first hole side surface 62*a*.

As illustrated in FIGS. 7A to 7C, the second cut hole 64 of the second pulley 50 includes a third hole side surface 64*a* which engages with the second projection side surface 42*e* of the projecting portion 42*c* in the rotating shaft member 42 at the initial position P0 and further includes a fourth hole side surface 64*b* which is separated in the first rotation direction R1 from the third hole side surface 64*a*.

As illustrated in FIGS. 7A, 7C, 9A, and 9C, in the first engagement-avoidance region A1 of the first cut hole 62 in the first pulley 48, engagement between the second projection side surface 42*e* of the projecting portion 42*c* in the rotating shaft member 42 and the second hole side surface 62*b* of the first cut hole 62 is avoidable when the projecting portion 42*c* of the rotating shaft member 42 is located between the initial position P0 and the second maximum rotation position P2.

Figure 8A:
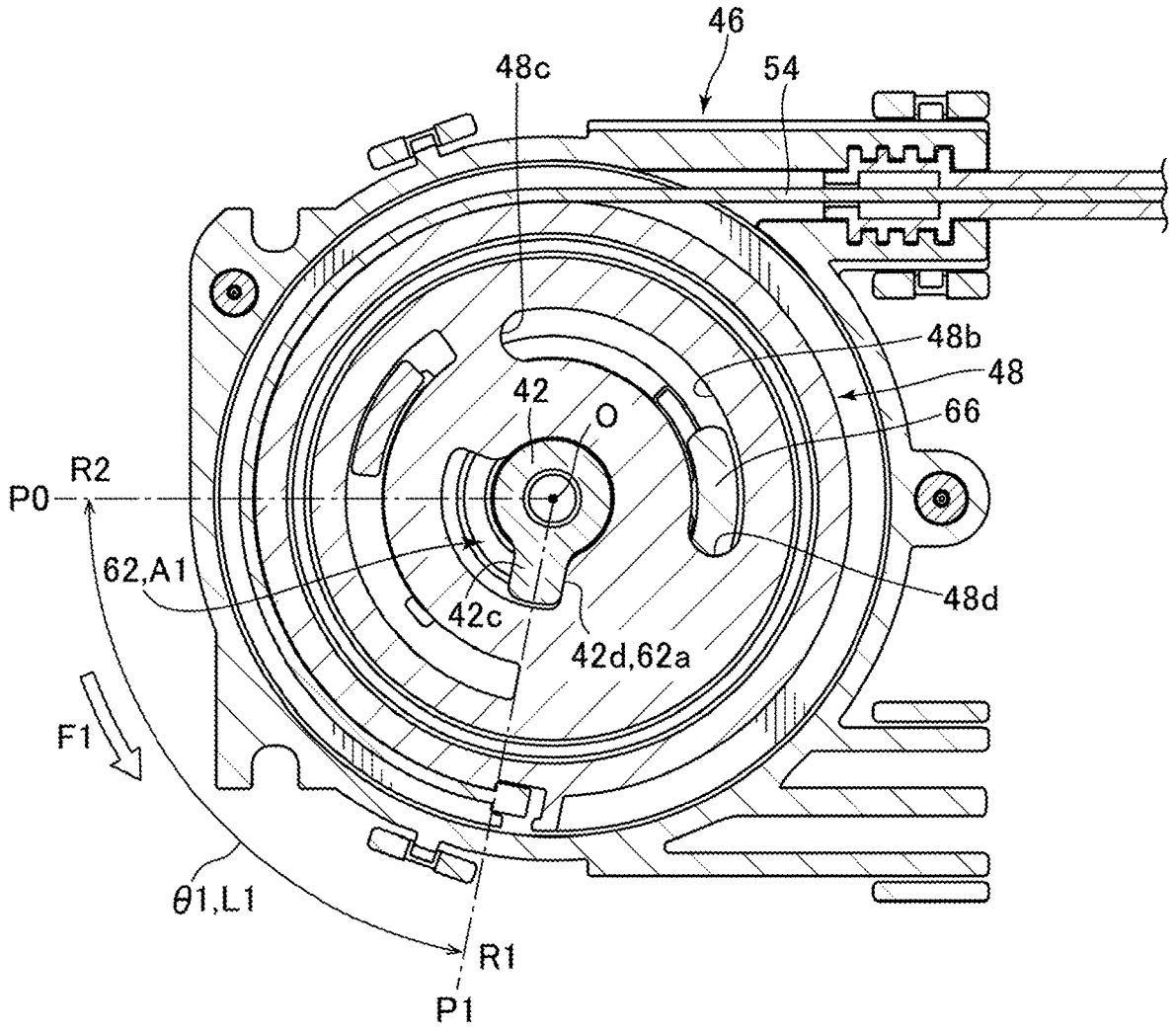
FIG. 8A is a sectional view taken along line A-A in FIG. 6 and illustrates a state at the time of an exit from a full-flush operation mode in the electric operation unit of the discharge valve operating device according to the first embodiment of the present invention.
Figure 8B:
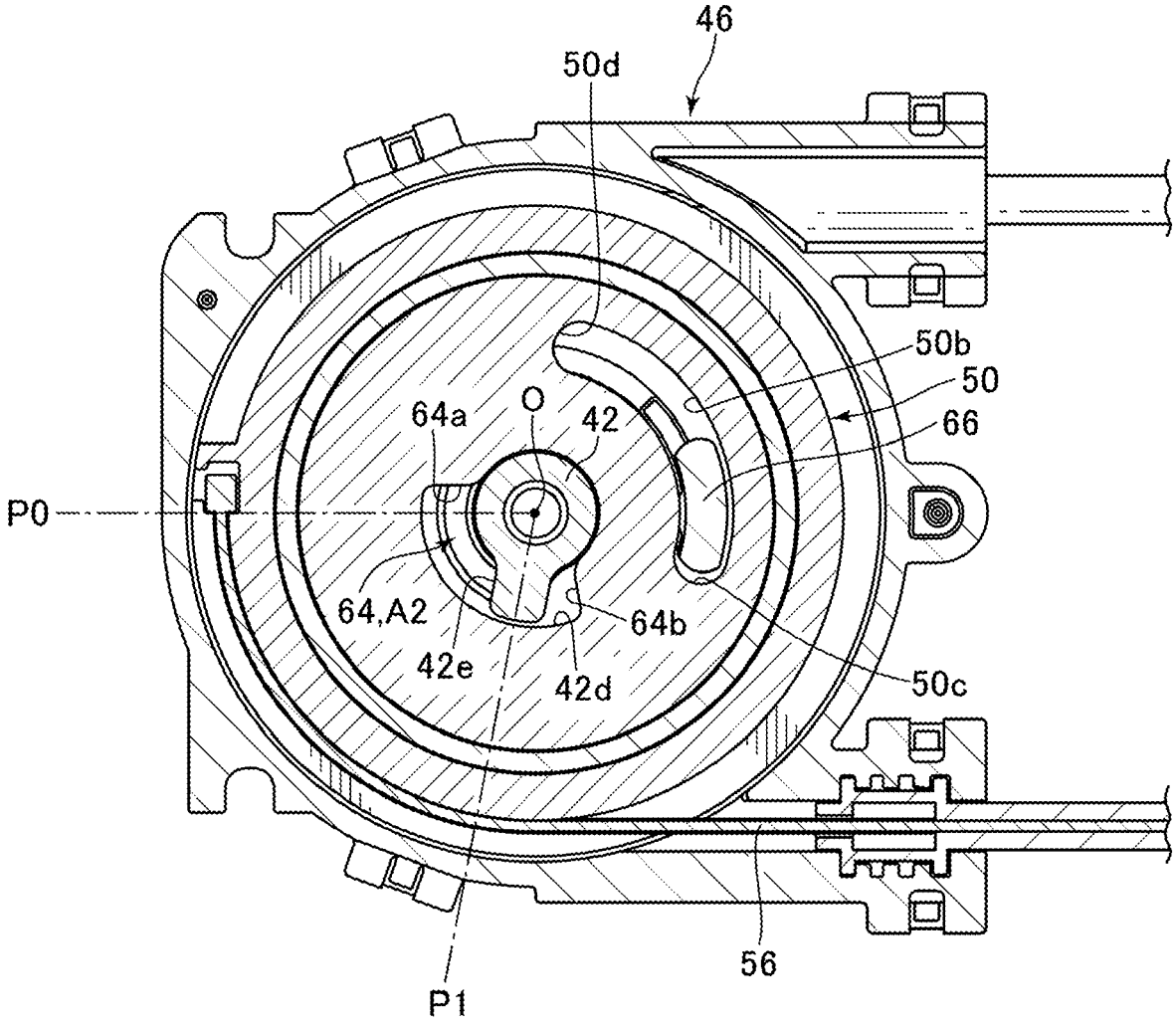
FIG. 8B is a sectional view taken along line B-B in FIG. 6 and illustrates a state at the time of the exit from the full-flush operation mode in the electric operation unit of the discharge valve operating device according to the first embodiment of the present invention.
Figure 8C:
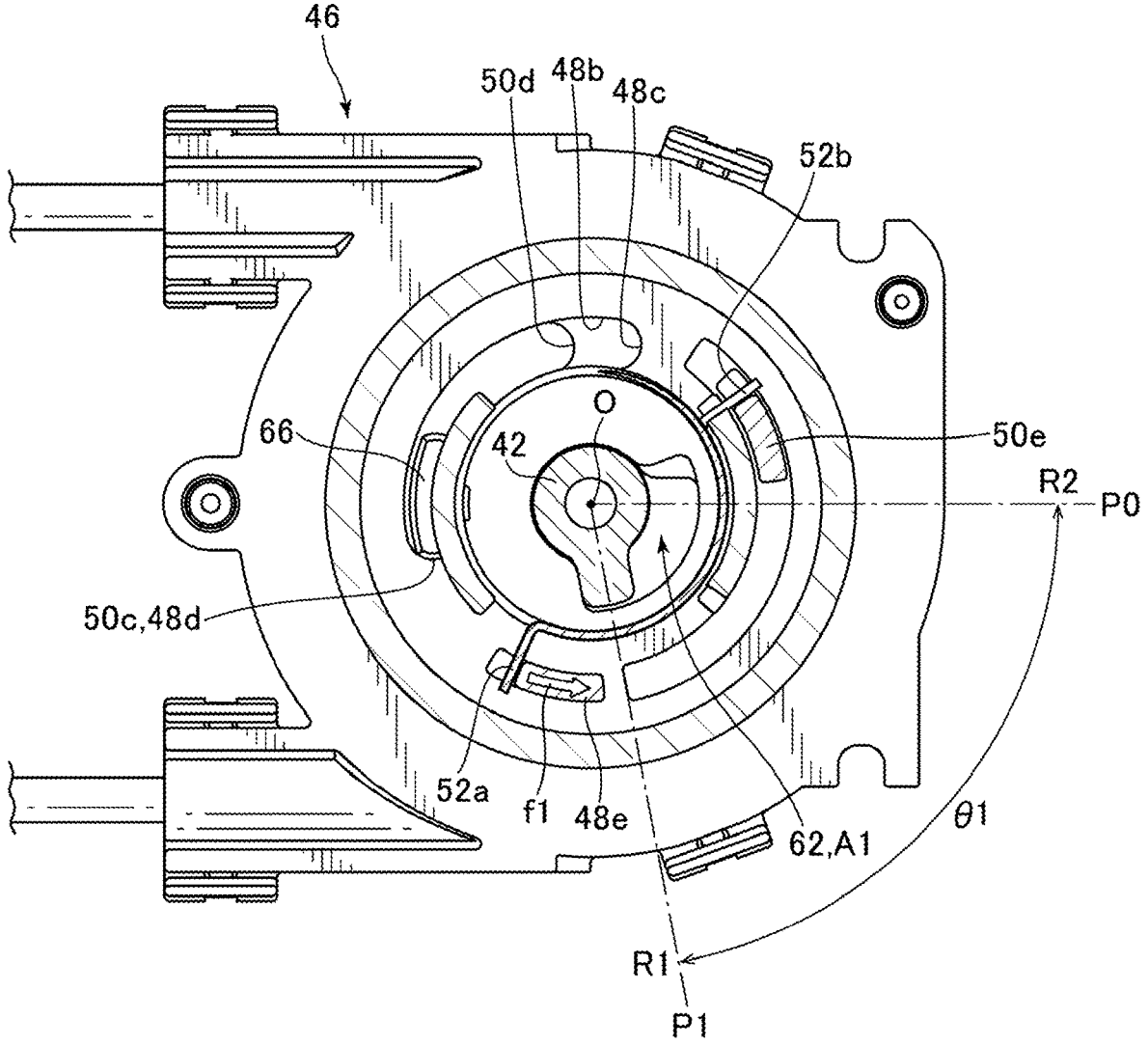
FIG. 8C is a sectional view taken along line C-C in FIG. 6 and illustrates a state at the time of the exit from the full-flush operation mode in the electric operation unit of the discharge valve operating device according to the first embodiment of the present invention.
Figure 8D:
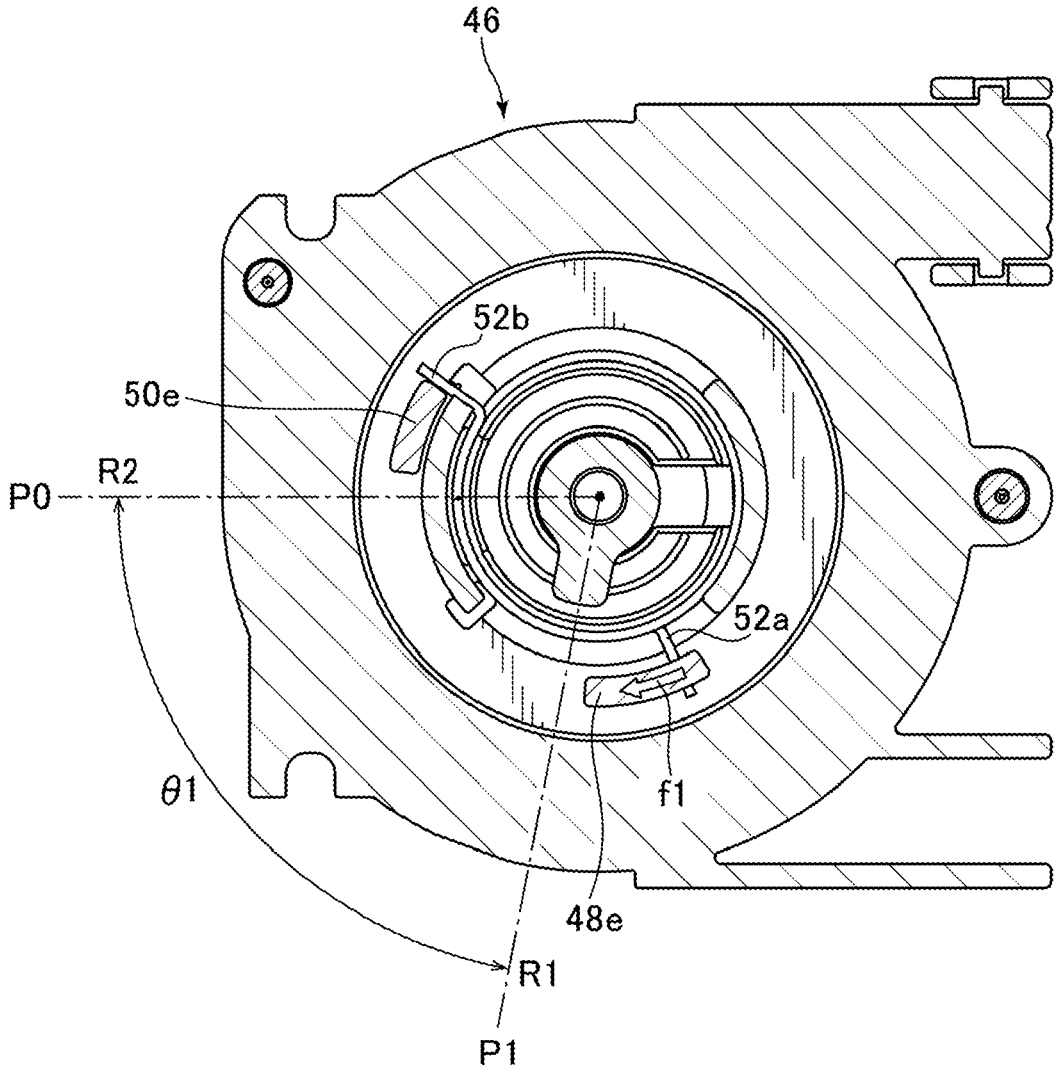
FIG. 8D is a sectional view taken along line D-D in FIG. 6 and illustrates a state at the time of the exit from the full-flush operation mode in the electric operation unit of the discharge valve operating device according to the first embodiment of the present invention.

As illustrated in FIGS. 7B and 8B, in the second engagement-avoidance region A2 of the second cut hole 64 in the second pulley 50, engagement between the first projection side surface 42*d* of the projecting portion 42*c* in the rotating shaft member 42 and the fourth hole side surface 64*b* of the second cut hole 64 is avoidable when the projecting portion 42*c* of the rotating shaft member 42 is located between the initial position P0 and the first maximum rotation position P1.

If the projecting portion 42*c* of the rotating shaft member 42 is rotated from the initial position P0 in the first rotation direction R1 in the first operation mode (full-flush operation mode) of the electric operation unit 10, as illustrated in FIGS. 7A, 7C, 8A, and 8C, the first hole side surface 62*a* of the first cut hole 62 and the first projection side surface 42*d* of the projecting portion 42*c* in the rotating shaft member 42 are kept in engagement with each other in the first engagement-avoidance region A1 of the first cut hole 62 in the first pulley 48.

At this time, the third hole side surface 64*a* of the second cut hole 64 and the second projection side surface 42*e* of the projecting portion 42*c* in the rotating shaft member 42 are brought out of engagement with each other in the second engagement-avoidance region A2 of the second cut hole 64 in the second pulley 50, as illustrated in FIGS. 7B and 8B.

Figure 9A:
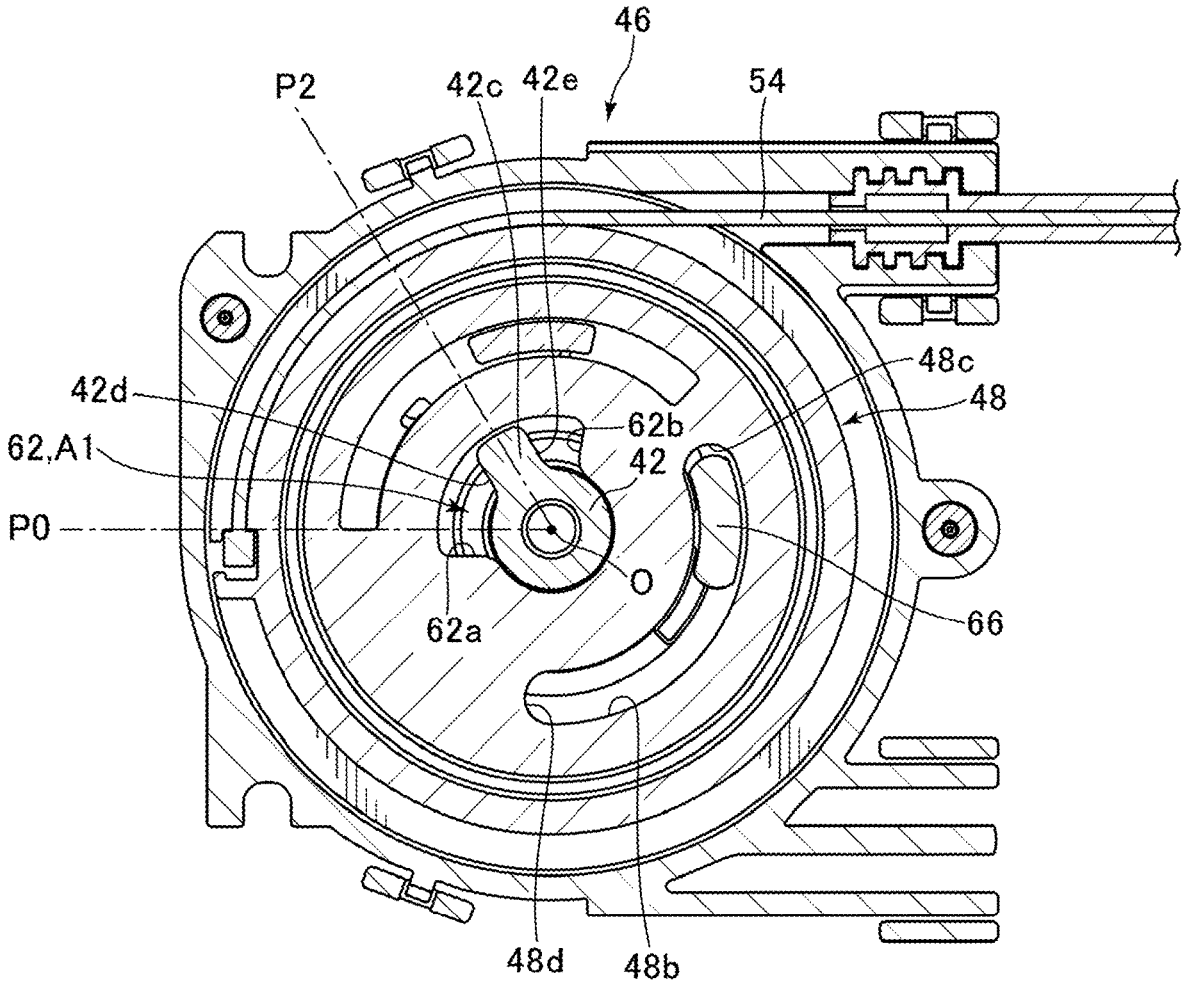
FIG. 9A is a sectional view taken along line A-A in FIG. 6 and illustrates a state at the time of an exit from a partial-flush operation mode in the electric operation unit of the discharge valve operating device according to the first embodiment of the present invention.
Figure 9B:
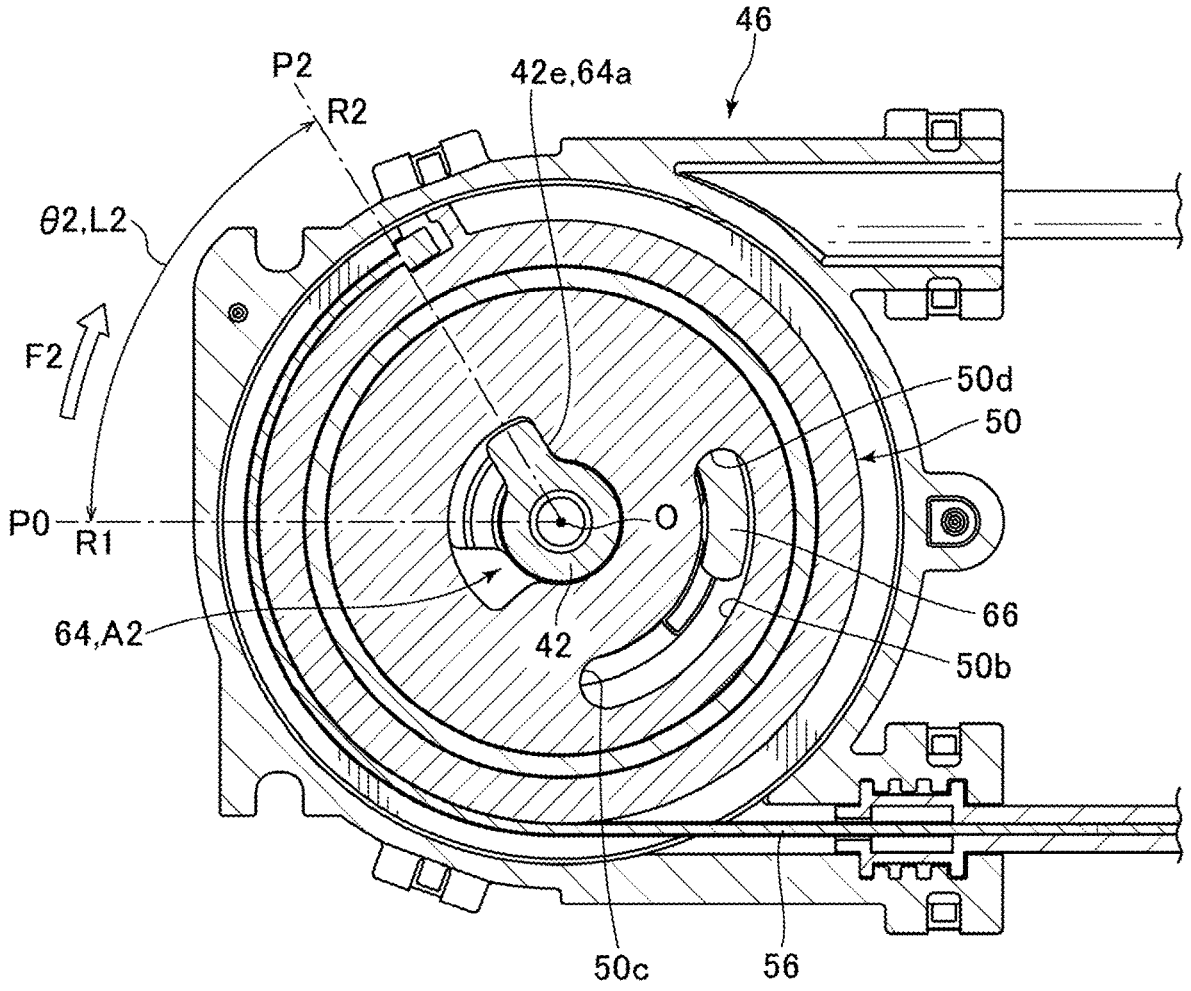
FIG. 9B is a sectional view taken along line B-B in FIG. 6 and illustrates a state at the time of the exit from the partial-flush operation mode in the electric operation unit of the discharge valve operating device according to the first embodiment of the present invention.
Figure 9C:
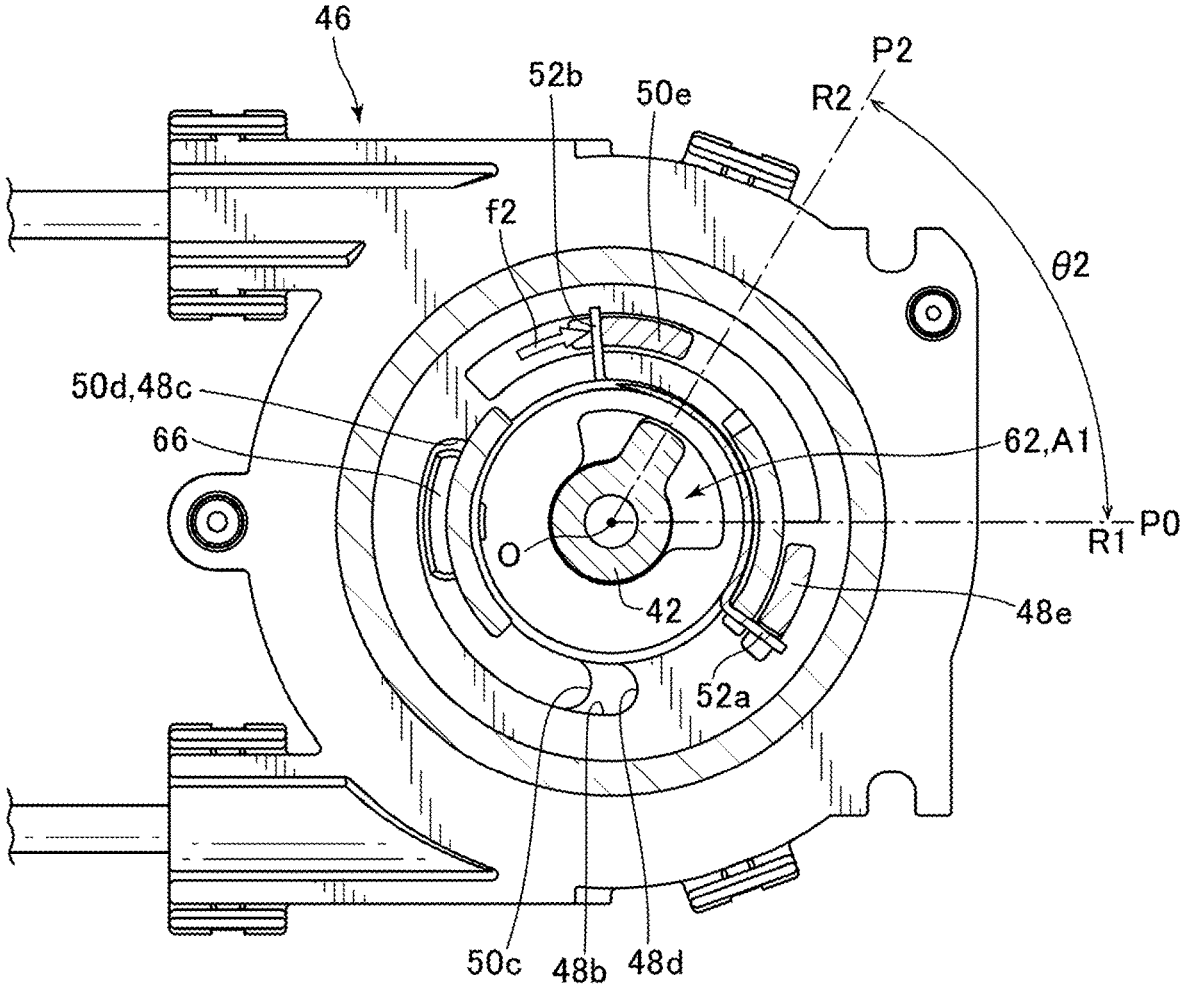
FIG. 9C is a sectional view taken along line C-C in FIG. 6 and illustrates a state at the time of the exit from the partial-flush operation mode in the electric operation unit of the discharge valve operating device according to the first embodiment of the present invention.
Figure 9D:
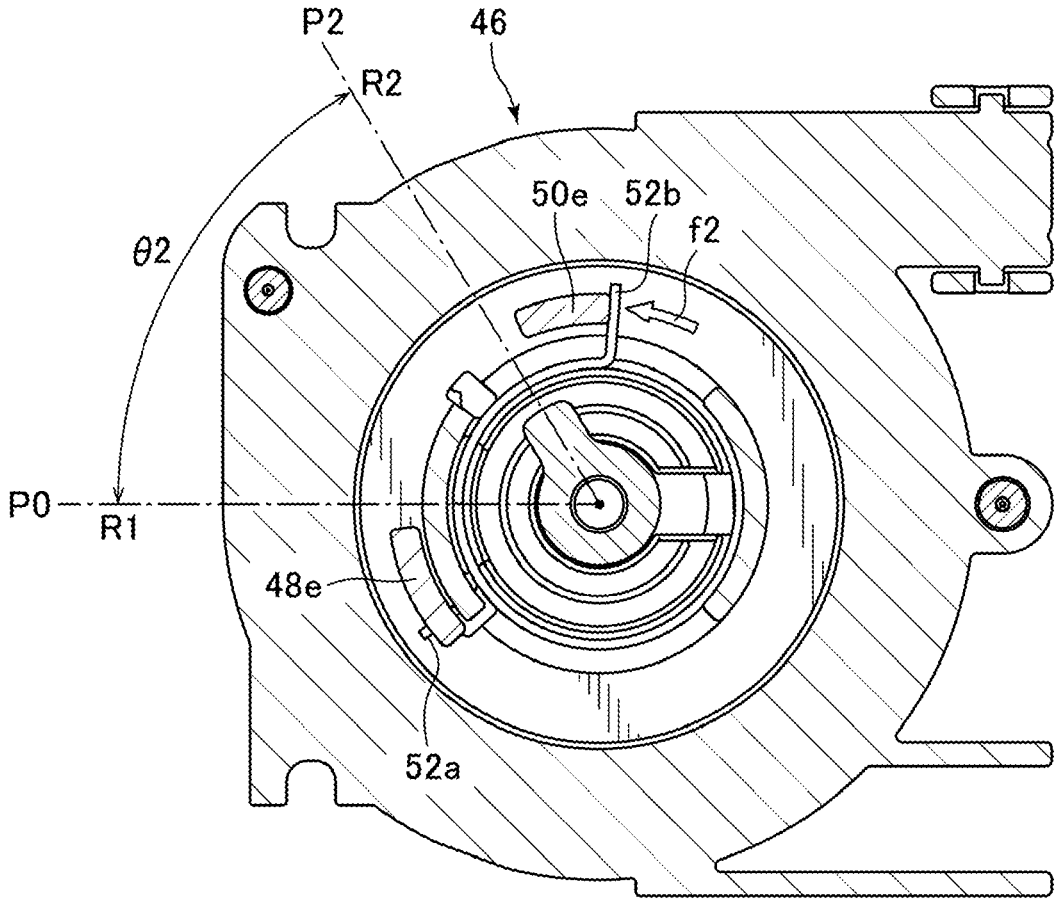
FIG. 9D is a sectional view taken along line D-D in FIG. 6 and illustrates a state at the time of the exit from the partial-flush operation mode in the electric operation unit of the discharge valve operating device according to the first embodiment of the present invention.

On the other hand if the projecting portion 42*c* of the rotating shaft member 42 is rotated from the initial position P0 in the second rotation direction R2 in the second operation mode (partial-flush operation mode) of the electric operation unit 10, as illustrated in FIGS. 7B and 9B, the third hole side surface 64*a* of the second cut hole 64 and the second projection side surface 42*e* of the projecting portion 42*c* in the rotating shaft member 42 are kept in engagement with each other in the second engagement-avoidance region A2 of the second cut hole 64 in the second pulley 50.

At this time, the first hole side surface 62*a* of the first cut hole 62 and the first projection side surface 42*d* of the projecting portion 42*c* in the rotating shaft member 42 are brought out of engagement with each other in the first engagement-avoidance region A1 of the first cut hole 62 in the first pulley 48, as illustrated in FIGS. 7A, 7C, 9A, and 9C.

As illustrated in FIGS. 7A and 7B, the first pulley 48 and the second pulley 50 include a first wire mounting hole 48*a* (a first wire mounting portion) and a second wire mounting hole 50*a* (a second wire mounting portion) at outer peripheries thereof. Projections 54*a* and 56*a* for mounting at the one ends of the electric wires 54 and 56 are fit in and mounted to the mounting holes 48*a* and 50*a*.

As illustrated in FIGS. 7A and 7B, the wire mounting holes 48*a* and 50*a* of the pulleys 48 and 50 are arranged on a line almost parallel to a direction of the rotation central axis O of the pulleys 48 and 50 when the wire mounting holes 48*a* and 50*a* are at the initial position P0.

In elevation view illustrated in FIGS. 7A and 7B, the electric wires 54 and 56 are arranged symmetrically to each other on one side and the other side of the rotation central axis O of the pulleys 48 and 50.

Additionally, as illustrated in FIG. 7A, the first wire mounting hole 48*a* in the first pulley 48 and the projection 54*a* of the first electric wire 54 are set at positions where the first electric wire 54 has been wound up in the first rotation direction R1 along the outer periphery of the first pulley 48 by a predetermined length L0 [mm] when the first wire mounting hole 48*a* and the projection 54*a* are at the initial position P0.

Similarly, as illustrated in FIG. 7B, the second wire mounting hole 50*a* in the second pulley 50 and the projection 56*a* of the second electric wire 56 are set at positions where the second electric wire 56 has been wound up in the second rotation direction R2 along the outer periphery of the second pulley 50 by the predetermined length L0 [mm] when the second wire mounting hole 50*a* and the projection 56*a* are at the initial position P0.

As illustrated in FIGS. 4, 5, 7A to 7C, 8A to 8C, and 9A to 9C, guide grooves 48*b* and 50*b* for rotation restriction are formed in the shapes of arcs around the rotation central axis O on inner peripheral sides of the pulleys 48 and 50.

As illustrated in FIGS. 5, 7A to 7C, 8A to 8C, and 9A to 9C, a projection 66 for rotation restriction is formed on an inner side surface of the casing 46 (the second casing 46*b*) in the electric operation unit 10 so as to extend in an axial direction. The projection 66 for rotation restriction extends through the guide grooves 48*b* and 50*b* for rotation restriction of the pulleys 48 and 50 in the axial direction.

Additionally, as illustrated in FIGS. 7A, 7C, 8A, 8C, 9A, and 9C, one end and the other end in a circumferential direction of the guide groove 48*b* in the first pulley 48 serve as a first engaging portion 48*c* and a second engaging portion 48*d* which can engage with the projection 66 for rotation restriction in accordance with each flush operation mode of the electric operation unit 10.

Note that the first pulley 48 is set such that the first engaging portion 48*c* of the guide groove 48*b* engages with the projection 66 for rotation restriction (see FIGS. 7A and 7C) when the first pulley 48 is at the initial position P0 and is set such that the second engaging portion 48*d* of the guide groove 48*b* engages with the projection 66 for rotation restriction (see FIGS. 8A and 8C) when the first pulley 48 is at the first maximum rotation position P1.

Similarly, as illustrated in FIGS. 7B, 7C, 8B, 8C, 9B, and 9C, one end and the other end in a circumferential direction of the guide groove 50*b* in the second pulley 50 serve as a third engaging portion 50*c* and a fourth engaging portion 50*d* which can engage with the projection 66 for rotation restriction in accordance with each flush operation mode of the electric operation unit 10.

Note that the second pulley 50 is set such that the third engaging portion 50*c* of the guide groove 50*b* engages with the projection 66 for rotation restriction (see FIGS. 7B and 7C) when the second pulley 50 is at the initial position P0 and is set such that the fourth engaging portion 50*d* of the guide groove 50*b* engages with the projection 66 for rotation restriction (see FIGS. 9B and 9C) when the second pulley 50 is at the second maximum rotation position P2.

With the above-described configurations, a range of the first maximum rotation angle θ1 between the initial position P0 and the first maximum rotation position P1 in the first pulley 48 in the full-flush operation mode of the electric operation unit 10 can be limited, and a range of the second maximum rotation angle θ2 between the initial position P0 and the second maximum rotation position P2 in the second pulley 50 in the partial-flush operation mode of the electric operation unit 10 can be limited, as illustrated in FIGS. 7A to 7C, 8A to 8C, and 9A to 9C.

As illustrated in FIGS. 4, 7A, and 7B, a maximum outer diameter D1 of the first pulley 48 and a maximum outer diameter D2 of the second pulley 50 are set almost identical to each other (D1=D2), and the maximum outer diameters D1 and D2 are set larger than a maximum outer diameter D3 (see FIG. 4) of the electric rotating shaft 40*a* and a maximum outer diameter D4 (see FIG. 4) of the base portion 42*a* in the rotating shaft member 42 (D1, D2>D3, D4).

Thus, as illustrated in FIGS. 4, 7A, and 7B, a maximum rotation radius r1 (=D1/2) of the first pulley 48 and a maximum rotation radius r2 (=D2/2) of the second pulley 50 are set almost identical to each other (r1=r2) and are set larger than a maximum rotation radius r3 (=D3/2) of the electric rotating shaft 40*a* and a maximum rotation radius r4 of the projecting portion 42*c* in the rotating shaft member 42 (r1, r2>r3, r4).

That is, as illustrated in FIGS. 3, 7A, 7C, 8A, and 8C, the first pulley 48 is rotatable with the maximum rotation radius r1 (=r2) that is almost identical to that of the second pulley 50 independently of the second pulley 50 between the initial position (standby position) P0 where the discharge valve body 18 of the discharge valve device 14 is closed and is at a lowest position and the first maximum rotation position P1 in the first operation mode (full-flush operation mode) of the electric operation unit 10. Here, the first maximum rotation position P1 for the first pulley 48 corresponds to the highest opened valve position P1 (a first highest position) for the full-flush mode where the discharge valve body 18 is opened.

As illustrated in FIGS. 3, 7B, and 8B, the second pulley 50 is rotatable with the maximum rotation radius r2 (=r1) that is almost identical to that of the first pulley 48 independently of the first pulley 48 between the initial position (standby position) P0 and the second maximum rotation position P2 in the second operation mode (partial-flush operation mode) of the electric operation unit 10. Here, the second maximum rotation position P2 for the second pulley 50 corresponds to the highest opened valve position P2 (a second highest position) for the partial-flush mode where the discharge valve body 18 is opened and is lower than the highest opened valve position P1 (the first highest position) for the full-flush mode.

Additionally, the first maximum rotation angle θ1 when the first pulley 48 together with the rotating shaft member 42 rotates from the initial position P0 to the first maximum rotation position P1 in the first rotation direction R1 in the first operation mode (full-flush operation mode) of the electric operation unit 10, as illustrated in FIGS. 7A and 8A, is set larger (θ1>θ2) than the second maximum rotation angle θ2 when the second pulley 50 rotates from the initial position P0 to the second maximum rotation position P2 in the second rotation direction R2, as illustrated in FIGS. 7B and 9B.

Here, the first maximum rotation angle θ1 is preferably set to 75 to 105 degrees, more preferably 85 to 95 degrees.

The second maximum rotation angle θ2 is preferably set to 45 to 75 degrees, more preferably 55 to 65 degrees.

With the above-described configurations, as illustrated in FIG. 8A, a first wind-up amount L1 (a first amount) which is a length of a wound-up portion of the first electric wire 54 when the first electric wire 54 alone is wound up by the first pulley 48 in the first operation mode (full-flush operation mode) of the electric operation unit 10 is set larger than a second wind-up amount L2 (a second amount) that is a length, by which the second electric wire 56 alone is wound up by the second pulley 50.

A first flush water amount W1, by which flush water is supplied from the flush water tank device 4 to the flush toilet 2 in a first flush mode (the full-flush mode), is set larger than a second flush water amount W2, by which flush water is supplied from the flush water tank device 4 to the flush toilet 2 in a second flush mode (the partial-flush mode) (W1>W2).

As illustrated in FIGS. 4, 5, 7C, 7D, 8C, 8D, 9C, and 9D, the return spring 52 is a torsion coil spring which is provided on a central axis almost identical to the rotation central axis O for the first pulley 48 and the second pulley 50.

As illustrated in FIGS. 4, 5, 7C, 7D, 8C, 8D, 9C, and 9D, the return spring 52 includes a first arm portion 52*a* and a second arm portion 52*b* which extend outward from one end and the other end, respectively, of the return spring 52.

Additionally, as illustrated in FIGS. 5, 7C, 7D, 8C, 8D, 9C, and 9D, the first pulley 48 includes a projection 48*e* for first arm portion mounting (a first arm mounting portion), to which the first arm portion 52*a* of the return spring 52 is to be mounted.

Similarly, as illustrated in FIGS. 5, 7C, 7D, 8C, 8D, 9C, and 9D, the second pulley 50 includes a projection 50*e* for second arm portion mounting (a second arm mounting portion), to which the second arm portion 52*b* of the return spring 52 is to be mounted.

As illustrated in FIGS. 7A, 7C, 7D, 8A, 8C, and 8D, while the first pulley 48 together with the rotating shaft member 42 is rotating from the initial position P0 to the first maximum rotation position P1 in the first rotation direction R1 in a first half of operation in the first operation mode (full-flush operation mode) of the electric operation unit 10, the first arm portion 52*a* of the return spring 52 exerts a first biasing force f1 (<F1) in the second rotation direction R2 which is smaller than a turning force F1 in the first rotation direction R1 of the first pulley 48 on the first arm mounting portion 48*e* of the first pulley 48. For this reason, the rotating shaft member 42 of the electric operation unit 10, together with the electric rotating shaft 40*a*, rotates electrically from the initial position P0 to the first maximum rotation position P1 in the first rotation direction R1.

After that, as illustrated in FIGS. 7A, 7C, 7D, 8A, 8C, and 8D, when the electric rotating shaft 40*a* and the rotating shaft member 42 rotate from the first maximum rotation position P1 in the second rotation direction R2 and return to the initial position (standby position) P0 in a second half of the operation in the first operation mode (full-flush operation mode) of the electric operation unit 10, the turning force F1 in the first rotation direction R1 of the first pulley 48 at the first maximum rotation position P1 is released (F1=0). For this reason, the first pulley 48 rotates from the first maximum rotation position P1 to the initial position (standby position) P0 in the second rotation direction R2 under the first biasing force f1 in the second rotation direction R2 exerted from the first arm portion 52*a* of the return spring 52 on the first arm mounting portion 48*e* of the first pulley 48.

As a result, the first pulley 48 makes a return to the initial position (standby position) P0 as the origin before an entry into the first operation mode (full-flush operation mode) to exit the first operation mode (full-flush operation mode).

As illustrated in FIGS. 7B to 7D and 9B to 9D, while the second pulley 50 together with the rotating shaft member 42 is rotating from the initial position P0 to the second maximum rotation position P2 in the second rotation direction R2 in a first half of operation in the second operation mode (partial-flush operation mode) of the electric operation unit 10, the second arm portion 52*b* of the return spring 52 exerts a second biasing force f2 (<F2) in the first rotation direction R1 which is smaller than a turning force F2 in the second rotation direction R2 of the second pulley 50 on the second arm mounting portion 50*e* of the second pulley 50. For this reason, the rotating shaft member 42 of the electric operation unit 10, together with the electric rotating shaft 40*a*, rotates electrically from the initial position P0 to the second maximum rotation position P2 in the second rotation direction R2.

After that, as illustrated in FIGS. 7B to 7D and 9B to 9D, when the electric rotating shaft 40*a* and the rotating shaft member 42 rotate from the second maximum rotation position P2 in the first rotation direction R1 and return to the initial position (standby position) P0 in a second half of the operation in the second operation mode (partial-flush operation mode) of the electric operation unit 10, the turning force F2 in the second rotation direction R2 of the second pulley 50 at the second maximum rotation position P2 is released (F2=0). For this reason, the second pulley 50 rotates from the second maximum rotation position P2 to the initial position (standby position) P0 in the first rotation direction R1 under the second biasing force f2 in the first rotation direction R1 exerted from the second arm portion 52*b* of the return spring 52 on the second arm mounting portion 50*e* of the second pulley 50.

As a result, the second pulley 50 makes a return to the initial position (standby position) P0 as the origin before an entry into the second operation mode (partial-flush operation mode) to exit the second operation mode (partial-flush operation mode).

Figure 10C:
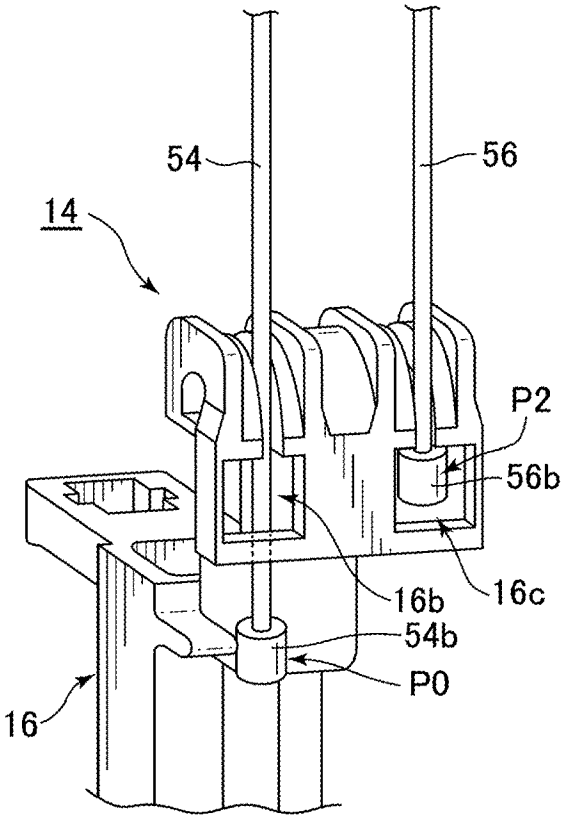
FIG. 10(C) is a schematic perspective view illustrating a status of coupling between the electric wires and the wire mounting portions of the discharge valve device in the state at the time of the exit from the partial-flush operation mode in the electric operation unit of the discharge valve operating device according to the first embodiment of the present invention.
Figure 10B:
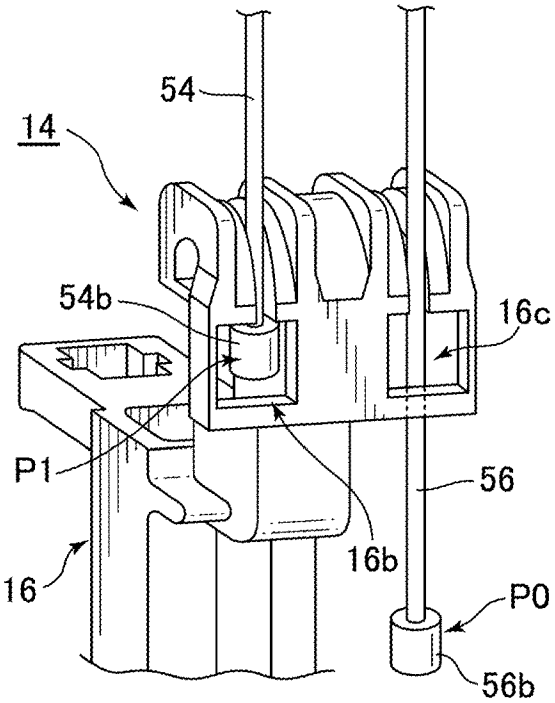
FIG. 10(B) is a schematic perspective view illustrating a status of coupling between the electric wires and the wire mounting portions of the discharge valve device in the state at the time of the exit from the full-flush operation mode in the electric operation unit of the discharge valve operating device according to the first embodiment of the present invention.
Figure 10A:
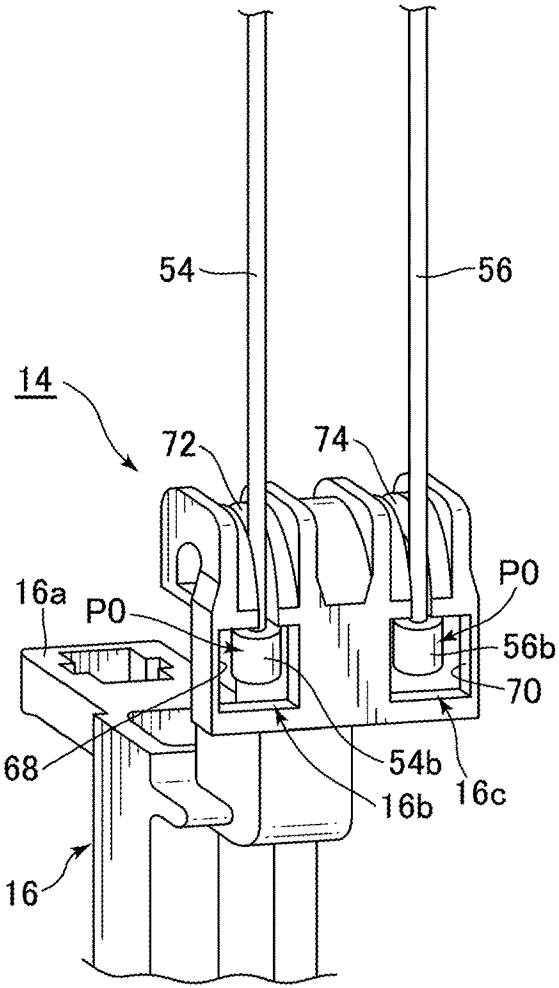
FIG. 10(A) is a schematic perspective view illustrating a status of coupling between electric wires and wire mounting portions of the discharge valve device in the initial state (standby state) before the entry into each flush operation mode in the electric operation unit of the discharge valve operating device according to the first embodiment of the present invention.

FIG. 10(A) is a schematic perspective view illustrating a status of coupling between electric wires and wire mounting portions of the discharge valve device in the initial state (standby state) before an entry into each flush operation mode in the electric operation unit of the discharge valve operating device according to the first embodiment of the present invention.

FIG. 10(B) is a schematic perspective view illustrating a status of coupling between the electric wires and the wire mounting portions of the discharge valve device at the time of an exit from the full-flush operation mode in the electric operation unit of the discharge valve operating device according to the first embodiment of the present invention.

FIG. 10(C) is a schematic perspective view illustrating a status of coupling between the electric wires and the wire mounting portions of the discharge valve device at the time of an exit from the partial-flush operation mode in the electric operation unit of the discharge valve operating device according to the first embodiment of the present invention.

As illustrated in FIG. 10(A), the first wire mounting portion 16*b* for full-flush operation and the second wire mounting portion 16*c* for partial-flush operation are provided at a front of the mounting portion 16*a* for manual operation at the upper end portion of the spindle member 16 in the discharge valve device 14 and form mounting holes 68 and 70, from which the projections 54*b* and 56*b* at the other ends of the electric wires 54 and 56 can be dismounted in a front-back direction.

The wire mounting portions 16*b* and 16*c* are integrally provided side by side in a direction horizontal and lateral to each other, and vertical holes 72 and 74 are formed above the mounting holes 68 and 70 so as to extend in the vertical direction.

The vertical holes 72 and 74 are set larger than thicknesses of the electric wires 54 and 56 and smaller than widths of the projections 54*b* and 56*b*. With this configuration, the electric wires 54 and 56 are coupled such that the projections 54*b* and 56*b* can engage with/disengage from the wire mounting portions 16*b* and 16*c*.

For example, when the electric operation unit 10 is operated in the first operation mode (full-flush operation mode), as illustrated in FIG. 10(B), the first electric wire 54 alone is pulled up to a first highest position P1, and the projection 54*b* alone of the first electric wire 54 engages with the first wire mounting portion 16*b* from below and does not come off upward. For this reason, the two wire mounting portions 16*b* and 16*c* are pulled up to the first highest position P1 by the first electric wire 54.

At this time, as illustrated in FIG. 10(B), the second electric wire 56 is not pulled up and stays at an initial position P0, and the second wire mounting portion 16*c* slides upward with respect to the second electric wire 56.

On the other hand, when the electric operation unit 10 is operated in the second operation mode (partial-flush operation mode), as illustrated in FIG. 10(C), the second electric wire 56 alone is pulled up to a second highest position P2 for the partial-flush operation mode which is lower than the first highest position P1, and the projection 56*b* alone of the second electric wire 56 engages with the second wire mounting portion 16*c* from below and does not come off upward. For this reason, the two wire mounting portions 16*b* and 16*c* are pulled up to the second highest position P2 by the second electric wire 56.

At this time, as illustrated in FIG. 10(C), the first electric wire 54 is not pulled up and stays at the initial position P0, and the first wire mounting portion 16*b* slides upward with respect to the first electric wire 54.

The operation (action) of the discharge valve operating device according to the first embodiment of the present invention will be described together with the operation of the discharge valve device with reference to FIGS. 1 to 10(A) to 10(C).

Operation when valve opening operation of the discharge valve device 14 is performed in the first operation mode (full-flush operation mode) by using the discharge valve operating device 1 according to the present embodiment will be described first.

As illustrated in FIG. 3, valve opening operation of the discharge valve body 18 of the discharge valve device 14 at the standby position P0, where the discharge valve body 18 closes the discharge port 6*b*, is performed in the full-flush mode through electric operation by the electric operation unit 10 in the discharge valve operating device 1 according to the present embodiment.

At this time, for example, when a user gives an instruction for toilet flush operation in the full-flush mode by pushing a predetermined operation button or the like of the command device C (see FIG. 1), such as a remote control (not illustrated), or the human sensor S (see FIG. 1) senses the user, a signal derived from the instruction or the sensing is transmitted to a controller (not illustrated) or the like of the command device C.

As illustrated in FIGS. 7A and 8A, the electric rotating shaft 40*a* of the electric operation unit 10 operates, the rotating shaft member 42 together with the electric rotating shaft 40*a* rotates about the rotation central axis O from the initial position (standby position) P0 in the first rotation direction R1, and valve opening operation in the full-flush mode is started.

More specifically, as illustrated in FIGS. 7A and 8A, the electric rotating shaft 40*a* and the rotating shaft member 42 of the actuator 40 are rotated from the initial position P0 to the first maximum rotation position P1 in the first rotation direction R1 in the first operation mode (full-flush operation mode) of the electric operation unit 10. Since the first hole side surface 62*a* of the first cut hole 62 in the first pulley 48 is engaged with the first projection side surface 42*d* of the projecting portion 42*c* in the rotating shaft member 42 in the first rotation direction R1, as illustrated in FIG. 8A, the first pulley 48 rotates in the first rotation direction R1.

For this reason, as illustrated in FIGS. 7A and 8A, the first pulley 48 together with the electric rotating shaft 40*a* and the rotating shaft member 42 rotates from the initial position P0 to the first maximum rotation position P1 in the first rotation direction R1 by the first maximum rotation angle θ1, independently of the second pulley 50.

At this time, since the second cut hole 64 in the second pulley 50 is out of engagement with the second projection side surface 42*e* of the projecting portion 42*c* in the rotating shaft member 42 in a rotation direction, as illustrated in FIG. 8B, the second pulley 50 is stationary at the initial position P0, regardless of the rotation of the first pulley 48.

As illustrated in FIG. 8A, the first electric wire 54 for full-flush mode operation alone is wound up by the first wind-up amount L1 by the first pulley 48.

For this reason, as illustrated in FIGS. 3 and 10(B), the spindle member 16 and the discharge valve body 18 of the discharge valve device 14 are pulled up by the maximum pull-up amount H1 (=L1) by the first electric wire 54.

The first flush water amount W1 of flush water is supplied from the flush water tank device 4 to the flush toilet 2 to execute toilet flushing in the first flush mode (full-flush mode).

As illustrated in FIGS. 7B and 9B, the electric rotating shaft 40*a* and the rotating shaft member 42 of the actuator 40 are rotated from the initial position P0 to the second maximum rotation position P2 in the second rotation direction R2 in the second operation mode (partial-flush operation mode) of the electric operation unit 10. Since the third hole side surface 64*a* of the second cut hole 64 in the second pulley 50 is engaged with the second projection side surface 42*e* of the projecting portion 42*c* in the rotating shaft member 42 in the second rotation direction R2, as illustrated in FIG. 9B, the second pulley 50 rotates in the second rotation direction R2.

For this reason, as illustrated in FIGS. 7B and 9B, the second pulley 50 together with the electric rotating shaft 40*a* and the rotating shaft member 42 rotates from the initial position P0 to the second maximum rotation position P2 in the second rotation direction R2 by the second maximum rotation angle θ2, independently of the first pulley 48.

At this time, since the first hole side surface 62*a* of the first cut hole 62 in the first pulley 48 is out of engagement with the first projection side surface 42*d* of the projecting portion 42*c* in the rotating shaft member 42 in the rotation direction, as illustrated in FIG. 9A, the first pulley 48 is stationary at the initial position P0, regardless of the rotation of the second pulley 50.

As illustrated in FIG. 9B, the second electric wire 56 for partial-flush mode operation alone is wound up by the second wind-up amount L2 by the second pulley 50.

For this reason, as illustrated in FIGS. 3 and 10(C), the spindle member 16 and the discharge valve body 18 of the discharge valve device 14 are pulled up by the maximum pull-up amount H2 (=L2<H1=L1) for the partial-flush operation mode smaller than the maximum pull-up amount H1 for the full-flush operation mode by the second electric wire 56.

The second flush water amount W2 of flush water is supplied from the flush water tank device 4 to the flush toilet 2 to execute toilet flushing in the second flush mode (partial-flush mode).

The above-described discharge valve operating device 1 according to the first embodiment of the present invention can independently rotate either one of the first pulley 48 and the second pulley 50 in accordance with each operation mode of the electric operation unit 10. The first pulley 48 and the second pulley 50 can operate smoothly while suppressing interference with each other.

The first electric wire 54 and the second electric wire 56 coupled to the first pulley 48 and the second pulley 50, respectively, can also operate smoothly while suppressing interference with each other.

Thus, since switching operation between the first operation mode (full-flush operation mode) and the second operation mode (partial-flush operation mode) that are different operation modes of the electric operation unit 10 can be accurately and smoothly performed, valve opening operation corresponding to each flush mode of the discharge valve body 18 of the discharge valve device 14 can be accurately performed.

As a result, the operability of the discharge valve operating device 1 can be improved, and toilet flushing in each of the first operation mode (full-flush operation mode) and the second operation mode (partial-flush operation mode) that are different flush modes can be accurately executed.

In the discharge valve operating device 1 according to the present embodiment, when toilet flushing in each of the first flush mode and the second flush mode that are different in flush water amount is to be executed, the electric rotating shaft 40*a* is electrically rotated in accordance with the flush mode by the electric operation unit 10.

At this time, either one of the first pulley 48 and the second pulley 50, together with the electric rotating shaft 40*a* and the rotating shaft member 42, can rotate independently and automatically with the rotation radius r1 or r2 larger than the rotation radiuses r3 and r4 of the electric rotating shaft 40*a* and the rotating shaft member 42 in a different direction corresponding to each flush mode.

If the electric operation unit 10 rotates the electric rotating shaft 40*a* in the first operation mode (full-flush operation mode), as illustrated in FIG. 8A, the electric operation unit 10 can automatically rotate the first pulley 48 together with the rotating shaft member 42 in the first rotation direction R1, independently of the second pulley 50.

Thus, the first electric wire 54 alone can be automatically wound up by the first wind-up amount L1 by the first pulley 48, and the discharge valve body 18 of the discharge valve device 14, together with the first electric wire 54, can be pulled up by the relatively large pull-up amount H1 (=L1).

Similarly, if the electric operation unit 10 rotates the electric rotating shaft 40*a* in the second operation mode (partial-flush operation mode), as illustrated in FIG. 9B, the electric operation unit 10 can automatically rotate the second pulley 50 together with the rotating shaft member 42 in the second rotation direction R2, independently of the first pulley 48.

Thus, the second electric wire 56 alone can be automatically wound up by the second wind-up amount L2 (<L1) by the second pulley 50, and the discharge valve device 14 together with the second electric wire 56 can be pulled up by the relatively small pull-up amount H2 (<H1).

In the discharge valve operating device 1 according to the present embodiment, if the electric rotating shaft 40*a* and the rotating shaft member 42 are rotated in the first rotation direction R1 in the first operation mode (full-flush operation mode) of the electric operation unit 10, as illustrated in FIG. 8A, the first cut hole 62 in the first pulley 48 rotates in the first rotation direction R1 in a state of being engaged with the projecting portion 42*c* of the rotating shaft member 42 in the rotation direction.

For this reason, as illustrated in FIGS. 7A and 8A, the first pulley 48 is rotatable from the initial position P0, where the discharge valve body 18 is closed and is at the lowest position P0 (see FIG. 3), to the first maximum rotation position P1 in the first rotation direction R1 within a range of the first maximum rotation angle θ1 and rotates with the rotation radius r1 (=r2) almost identical to the rotation radius r2 of the second pulley 50, independently of the second pulley 50. At this time, since the second cut hole 64 in the second pulley 50 is out of engagement with the projecting portion 42*c* of the rotating shaft member 42 in the rotation direction, as illustrated in FIG. 8B, the second pulley 50 is stationary, regardless of the rotation of the first pulley 48.

For this reason, as illustrated in FIG. 8A, the first electric wire 54 alone can be efficiently be wound up by the first wind-up amount L1 (>L2) by the first pulley 48 without interference of the second electric wire 56 with the first electric wire 54. As a result, as illustrated in FIG. 3, the discharge valve body 18 can be efficiently pulled up by the first pull-up amount H1 (=L1>H2=L2).

On the other hand, if the electric rotating shaft 40*a* and the rotating shaft member 42 are rotated in the second rotation direction R2 in the second operation mode (partial-flush operation mode) of the electric operation unit 10, as illustrated in FIG. 9B, the second cut hole 64 in the second pulley 50 rotates in the second rotation direction R2 in a state of being engaged with the projecting portion 42*c* of the rotating shaft member 42 in the rotation direction.

For this reason, as illustrated in FIGS. 7B and 9B, the second pulley 50 is rotatable from the initial position P0, where the discharge valve body 18 is closed and is at the lowest position P0 (see FIG. 3), to the second maximum rotation position P2 in the second rotation direction R2 within a range of the second maximum rotation angle θ2 and rotates with the rotation radius r2 (=r1) almost identical to the rotation radius r1 of the first pulley 48, independently of the first pulley 48. At this time, since the first cut hole 62 in the first pulley 48 is out of engagement with the projecting portion 42*c* of the rotating shaft member 42 in the rotation direction, as illustrated in FIG. 9B, the first pulley 48 is stationary, regardless of the rotation of the second pulley 50.

For this reason, as illustrated in FIG. 9B, the second electric wire 56 alone can be efficiently wound up by the second wind-up amount L2 (<L1) by the second pulley 50 without interference of the first electric wire 54 with the second electric wire 56. As a result, as illustrated in FIG. 3, the discharge valve body 18 can be efficiently pulled up by the second pull-up amount H2 (=L2<H1=L1).

Thus, either one of the first pulley 48 and the second pulley 50 can be independently rotated with a corresponding one of the rotation radiuses r1 and r2 almost identical to each other in accordance with each operation mode of the electric operation unit 10. Additionally, since the first maximum rotation angle θ1 of the first pulley 48 is set larger than the second maximum rotation angle θ2 of the second pulley 50 (θ1>θ2), each of the first pulley 48 and the second pulley 50 can be simply structured.

The first pulley 48 and the second pulley 50 can operate smoothly while suppressing interference with each other.

The first electric wire 54 and the second electric wire 56 coupled to the first pulley 48 and the second pulley 50, respectively, can also operate smoothly while suppressing interference with each other.

Thus, since switching operation between the first operation mode (full-flush operation mode) and the second operation mode (partial-flush operation mode) that are different operation modes of the electric operation unit 10 can be accurately and smoothly performed, valve opening operation corresponding to each flush mode of the discharge valve body 18 can be accurately performed.

As illustrated in FIGS. 7A, 8A, 8C, and 8D, in the discharge valve operating device 1 according to the present embodiment, the first arm portion 52*a* of the return spring 52 biases the projection 48*e* for first arm portion mounting of the first pulley 48 at the first maximum rotation position P1 in the second rotation direction R2 by the first biasing force f1 in the first operation mode (full-flush operation mode). This allows the first pulley 48 to return reliably and swiftly to the initial position P0.

Similarly, as illustrated in FIGS. 7B and 9B to 9D, the second arm portion 52*b* of the return spring 52 biases the projection 50*e* for second arm portion mounting of the second pulley 50 at the second maximum rotation position P2 in the first rotation direction R1 by the second biasing force f2 in the second operation mode. This allows the second pulley 50 to return reliably and swiftly to the initial position P0.

Thus, the first pulley 48 after an exit from the first operation mode (full-flush operation mode) and the second pulley 50 after an exit from the second operation mode (partial-flush operation mode) can be reliably and swiftly returned to the initial position P0 in preparation for next toilet flush operation (valve opening operation of the discharge valve device 14). It is also possible to accurately perform rotational operation associated with the first pulley 48 or the second pulley 50 corresponding to a next flush mode.

In the discharge valve operating device 1 according to the present embodiment, the first cut hole 62 in the first pulley 48 and the second cut hole 64 in the second pulley 50 are formed near portions at respective rotation centers (the rotation central axis O) such that the projecting portion 42*c* of the rotating shaft member 42 is insertable in the axial direction.

Additionally, as illustrated in FIGS. 7A, 7B, 8A, 8B, 9A, and 9B, the first cut hole 62 in the first pulley 48 and the second cut hole 64 in the second pulley 50 include the first engagement-avoidance region A1 and the second engagement-avoidance region A2, respectively, where engagement with the projecting portion 42*c* of the rotating shaft member 42 is avoidable in accordance with the rotation direction of the rotating shaft member 42.

With the above-described configuration, for example, when the rotating shaft member 42 of the electric operation unit 10 is located between the initial position P0 and the second maximum rotation position P2, as illustrated in FIG. 9A, the first engagement-avoidance region A1 of the first cut hole 62 in the first pulley 48 can avoid engagement between the second projection side surface 42*e* of the projecting portion 42*c* in the rotating shaft member 42 and the second hole side surface 62*b* of the first cut hole 62 in the first pulley 48 with a simple structure.

On the other hand, when the rotating shaft member 42 of the electric operation unit 10 is located between the initial position P0 and the first maximum rotation position P1, as illustrated in FIG. 8B, the second engagement-avoidance region A2 of the second cut hole 64 in the second pulley 50 can avoid engagement between the first projection side surface 42*d* of the projecting portion 42*c* in the rotating shaft member 42 and the fourth hole side surface 64*b* of the second cut hole 64 in the second pulley 50 with a simple structure.

In the discharge valve operating device 1 according to the present embodiment, if the projecting portion 42*c* of the rotating shaft member 42 is rotated from the initial position P0 in the first rotation direction R1 in the first operation mode (full-flush operation mode) of the electric operation unit 10, as illustrated in FIG. 8A, the first hole side surface 62*a* of the first cut hole 62 in the first pulley 48 and the first projection side surface 42*d* of the projecting portion 42*c* in the rotating shaft member 42 are kept in engagement with each other in the first engagement-avoidance region A1 of the first pulley 48.

At this time, as illustrated in FIG. 8B, the third hole side surface 64*a* of the second cut hole 64 in the second pulley 50 and the second projection side surface 42*e* of the projecting portion 42*c* in the rotating shaft member 42 are brought out of engagement with each other in the second engagement-avoidance region A2 of the second pulley 50.

On the other hand, if the projecting portion 42*c* of the rotating shaft member 42 is rotated from the initial position P0 in the second rotation direction R2 in the second operation mode (partial-flush operation mode) of the electric operation unit 10, as illustrated in FIG. 9B, the third hole side surface 64*a* of the second cut hole 64 in the second pulley 50 and the second projection side surface 42*e* of the projecting portion 42*c* in the rotating shaft member 42 are kept in engagement with each other in the second engagement-avoidance region A2 of the second pulley 50.

At this time, as illustrated in FIG. 9A, the first hole side surface 62*a* of the first cut hole 62 in the first pulley 48 and the first projection side surface 42*d* of the projecting portion 42*c* in the rotating shaft member 42 are brought out of engagement with each other in the first engagement-avoidance region A1 of the first pulley 48.

As a result, it is possible in each operation mode of the electric operation unit 10 to efficiently and independently rotate either one of the first pulley 48 and the second pulley 50, together with the projecting portion 42*c* of the rotating shaft member 42, in accordance with the operation mode while suppressing mutual interference between the first pulley 48 and the second pulley 50.

Thus, in each operation mode of the electric operation unit 10, either one of the first pulley 48 and the second pulley 50 can operate independently and smoothly while suppressing interference with the other pulley. This allows improvement in the electric operability of the electric operation unit 10 of the discharge valve operating device 1 corresponding to each operation mode.

In the discharge valve operating device 1 according to the present embodiment, the first wire mounting hole 48*a* in the first pulley 48 and the second wire mounting hole 50*a* in the second pulley 50 are arranged on a line almost parallel to the direction of the rotation central axis O of the first pulley 48 and the second pulley 50, as illustrated in FIGS. 7A and 7B.

As illustrated in FIGS. 7A and 7B, the first electric wire 54 and the second electric wire 56 are arranged symmetrically to each other on one side and the other side of the rotation central axis O of the first pulley 48 and the second pulley 50 in elevation view.

Additionally, as illustrated in FIGS. 7A and 7B, the first wire mounting hole 48*a* in the first pulley 48 and the projection 54*a* of the first electric wire 54 are set at positions where the first electric wire 54 has been wound up in the first rotation direction R1 along the outer periphery of the first pulley 48 by the predetermined length L0 [mm] when the first wire mounting hole 48*a* and the projection 54*a* are at the initial position P0.

At the same time, the second wire mounting hole 50*a* in the second pulley 50 and the projection 56*a* of the second electric wire 56 are set at positions where the second electric wire 56 has been wound up in the second rotation direction R2 along the outer periphery of the second pulley 50 by the predetermined length L0 [mm].

With the above-described configurations, even when either one of a first rotary winding member and a second rotary winding member rotates independently in accordance with each flush mode, either one of the first pulley 48 and the second pulley 50 can move reliably and smoothly without interference with the other pulley.

In the discharge valve operating device 1 according to the present embodiment, the casing 46 that rotatably holds the first pulley 48 and the second pulley 50 includes the projection 66 for rotation restriction, as illustrated in FIGS. 7A, 7B, 8A, 8B, 9A, and 9B.

Thus, when the first pulley 48 is at the initial position P0, as illustrated in FIG. 7A, the first engaging portion 48*c* of the guide groove 48*b* in the first pulley 48 can engage with the projection 66 for rotation restriction of the casing 46.

On the other hand, when the first pulley 48 is at the first maximum rotation position P1, as illustrated in FIG. 8A, the second engaging portion 48*d* of the guide groove 48*b* in the first pulley 48 can engage with the projection 66 for rotation restriction of the casing 46.

Additionally, when the second pulley 50 is at the initial position P0, as illustrated in FIG. 7B, the third engaging portion 50*c* of the guide groove 50*b* in the second pulley 50 can engage with the projection 66 for rotation restriction of the casing 46.

On the other hand, when the second pulley 50 is at the second maximum rotation position P2, as illustrated in FIG. 9B, the fourth engaging portion 50*d* of the guide groove 50*b* in the second pulley 50 can engage with the projection 66 for rotation restriction of the casing 46.

It is thus possible to reliably limit the range of the first maximum rotation angle θ1 between the initial position P0 and the first maximum rotation position P1 of the first pulley 48 and reliably limit the range of the second maximum rotation angle θ2 between the initial position P0 and the second maximum rotation position P2 of the second pulley 50.

Rotational operation of either one of the first pulley 48 and the second pulley 50 corresponding to each flush mode can be more accurately performed.

As a result, rotational operation of either one of the first pulley 48 and the second pulley 50 corresponding to each flush mode can be accurately performed.

It is thus possible to accurately manage the pull-up amounts H1 and H2 for the discharge valve body 18 at the time of valve opening operation corresponding to each flush mode.

In the discharge valve operating device 1 according to the present embodiment, when the projecting portion 42*c* of the rotating shaft member 42 and the first pulley 48 are rotated from the initial position P0 in the first rotation direction R1 in the first operation mode (full-flush operation mode) of the electric operation unit 10, as illustrated in FIG. 8A, since the first electric wire 54 alone is wound up by the first wind-up amount L1 by the first pulley 48, as illustrated in FIG. 10(B), the first wire mounting portion 16*b* of the spindle member 16 in the discharge valve device 14 is pulled up by the first maximum pull-up amount H1 in a state of being engaged with the projection 54*b* at the one end of the first electric wire 54.

At this time, as illustrated in FIG. 8B, the second pulley 50 is stationary, and the second electric wire 56 is not wound up.

Thus, as illustrated in FIG. 10(B), the second wire mounting portion 16*c* of the spindle member 16 in the discharge valve device 14 is pulled up together with the first wire mounting portion 16*b* of the discharge valve device 14 and the first electric wire 54 in a state of being out of engagement with the projection 56*b* at the one end of the second electric wire 56 and slides and moves upward with respect to the projection 56*b* at the one end of the second electric wire 56.

On the other hand, when the rotating shaft member 42 and the second pulley 50 are rotated from the initial position P0 in the second rotation direction R2 in the second operation mode (partial-flush operation mode) of the electric operation unit 10, as illustrated in FIG. 9B, since the second electric wire 56 alone is wound up by the second wind-up amount L2 by the second pulley 50, as illustrated in FIG. 10(C), the second wire mounting portion 16*c* of the discharge valve device 14 is pulled up in a state of being engaged with the projection 56*b* at the one end of the second electric wire 56.

At this time, as illustrated in FIG. 9A, the first pulley 48 is stationary, and the first electric wire 54 is not wound up.

Thus, as illustrated in FIG. 10(C), the first wire mounting portion 16*b* of the spindle member 16 in the discharge valve device 14 is pulled up together with the second wire mounting portion 16*c* of the discharge valve device 14 and the second electric wire 56 in a state of being out of engagement with the projection 54*b* at the one end of the first electric wire 54 and slides and moves upward with respect to the projection 54*b* at the one end of the first electric wire 54.

As a result, it is possible to suppress mutual interference between the first electric wire 54 and the second electric wire 56 during valve opening operation of the discharge valve body 18 of the discharge valve device 14 corresponding to each flush mode. It is also possible to suppress mutual interference between the first and second electric wires 54 and 56 and an associated structural portion, such as an internal part of the discharge valve device 14, surrounding the first electric wire 54 and the second electric wire 56.

Thus, valve opening operation of the discharge valve device 14 corresponding to each flush mode can be accurately performed, and the flush water amount W1 or W2 of flush water corresponding to each of the first flush mode (full-flush mode) and the second flush mode (partial-flush mode) that are different flush modes can be accurately supplied from the water storage tank 6 of the flush water tank device 4 to the flush toilet 2.

Additionally, in the discharge valve operating device 1 according to the present embodiment, valve opening operation of the discharge valve body 18 of the discharge valve device 14 can be performed not only through electric operation by the electric operation unit 10 but also through manual press operation of the operation buttons 30 and 32 of the manual operation unit 8.

Thus, at the time of execution of toilet flushing, one of electric operation by the electric operation unit 10 and manual press operation of the manual operation unit 8 can be properly selected and used in accordance with a user's preference.

Even if the need for maintenance or a problem arises in the electric operation unit 10 or trouble, such as a power failure, occurs, valve opening operation of the discharge valve body 18 of the discharge valve device 14 can be reliably performed through manual operation of the manual operation unit 8.

A discharge valve operating device according to a second embodiment of the present invention will be described with reference to FIG. 11.

Figure 11:
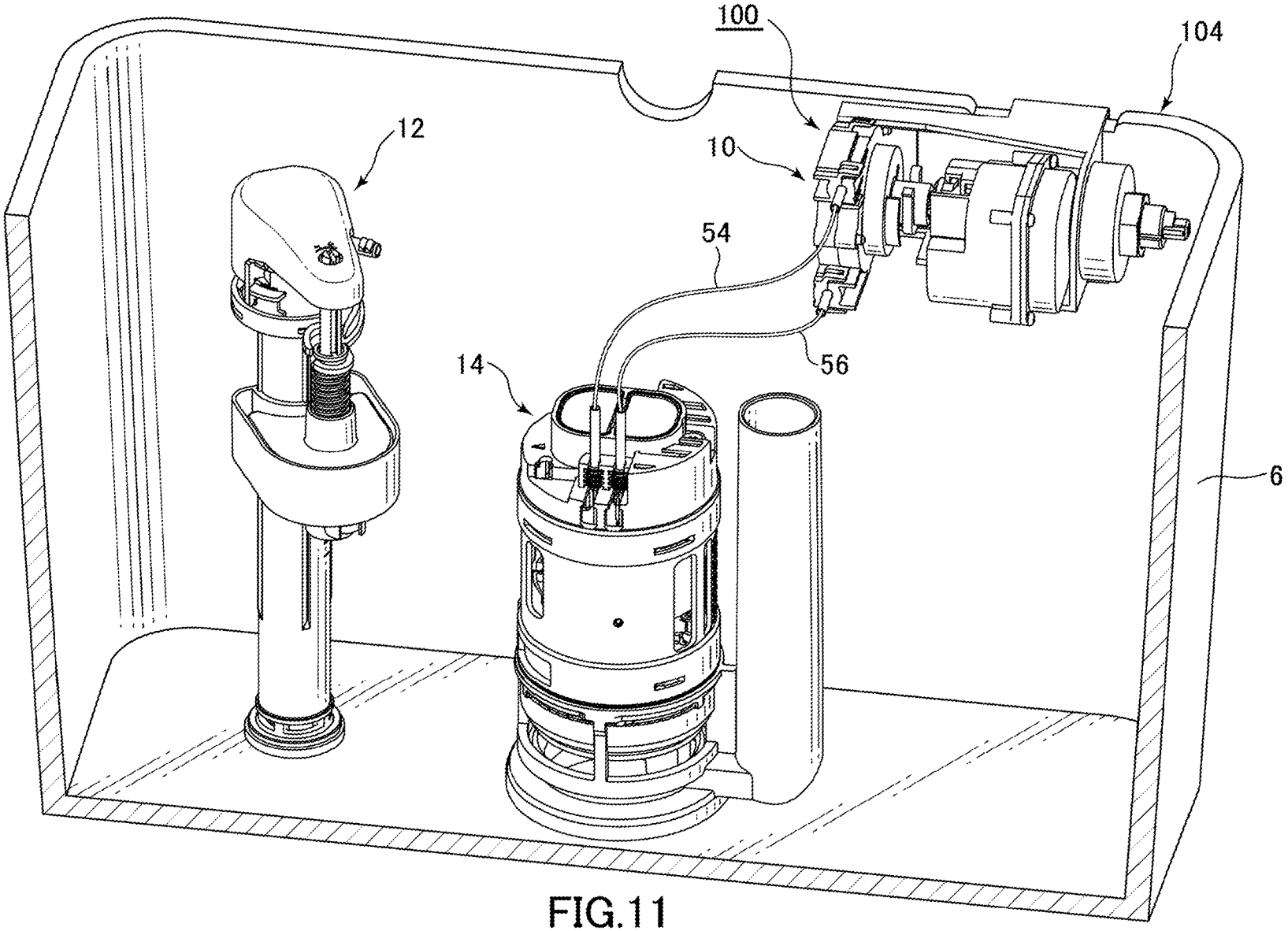
FIG. 11 is a schematic perspective view of an internal structure of a flush water tank device, to which a discharge valve operating device according to a second embodiment of the present invention is applied, as viewed obliquely from the front and above.

FIG. 11 is a schematic perspective view of an internal structure of a flush water tank device, to which the discharge valve operating device according to the second embodiment of the present invention is applied, as viewed obliquely from the front and above.

In a flush water tank device 104, to which a discharge valve operating device 100 according to the second embodiment of the present invention illustrated in FIG. 11 is applied, the same portions as in the flush water tank device 4, to which the discharge valve operating device 1 according to the first embodiment of the present invention illustrated in FIG. 2 is applied, are denoted by the same reference numerals, and a description thereof will be omitted.

As illustrated in FIG. 11, the discharge valve operating device 100 according to the second embodiment of the present invention is structurally different from the discharge valve operating device 1 according to the first embodiment of the present invention in that the discharge valve operating device 100 does not include the manual operation unit 8 illustrated in FIG. 2 but is identical in the rest.

In the discharge valve operating device 100 according to the present embodiment, space surrounding an electric operation unit 10 and a discharge valve device 14 inside the flush water tank device 104 and the like can be reduced by an amount corresponding to the omitted manual operation unit 8. This allows simplification of an internal structure of the flush water tank device 104.

Thus, the maintainability of the electric operation unit 10 and the discharge valve device 14 can be improved.

A discharge valve operating device according to a third embodiment of the present invention will be described with reference to FIG. 12.

Figure 12:
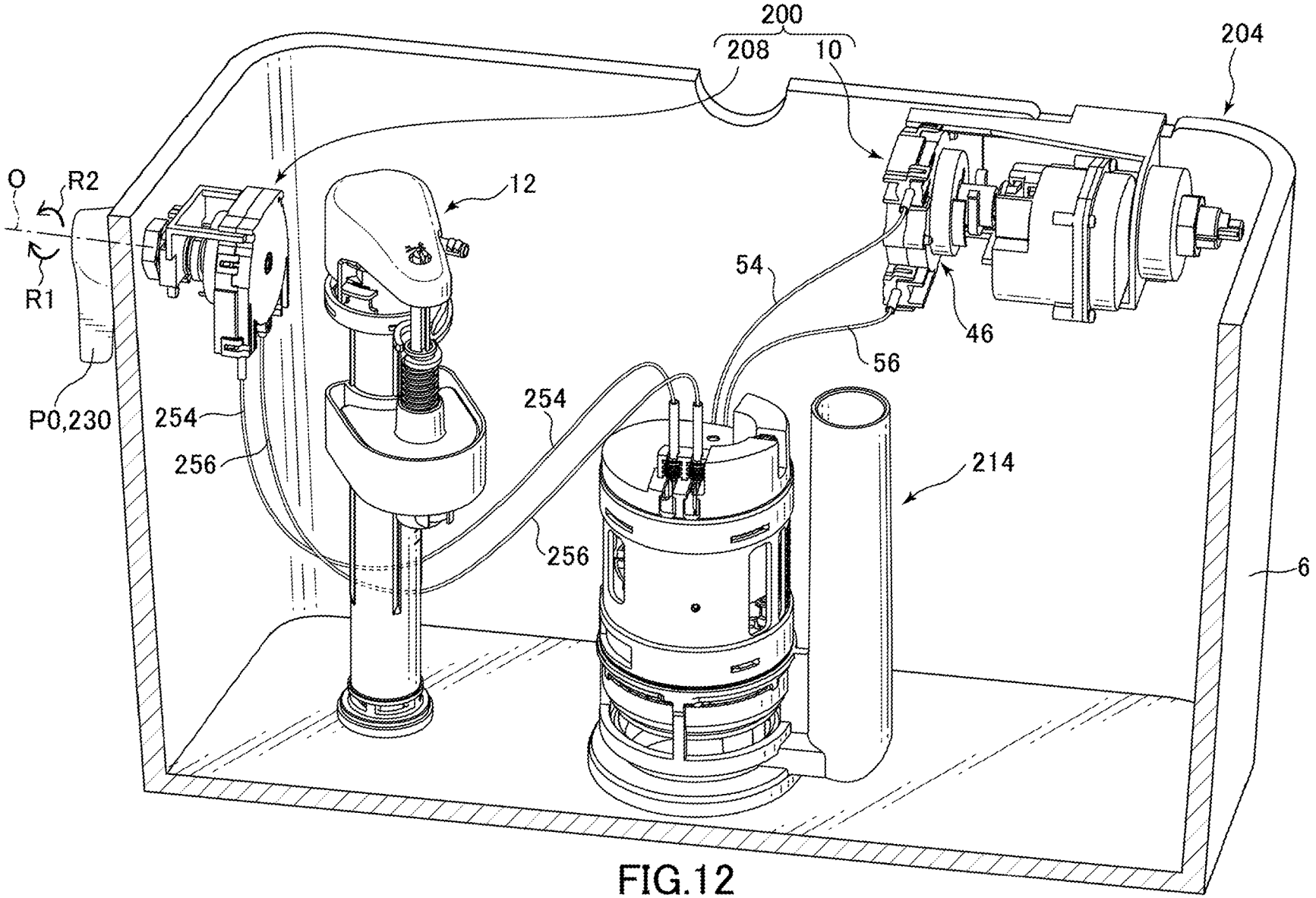
FIG. 12 is a schematic perspective view of an internal structure of a flush water tank device, to which a discharge valve operating device according to a third embodiment of the present invention is applied, as viewed obliquely from the front and above.

FIG. 12 is a schematic perspective view of an internal structure of a flush water tank device, to which the discharge valve operating device according to the third embodiment of the present invention is applied, as viewed obliquely from the front and above.

In a flush water tank device 204, to which a discharge valve operating device 200 according to the third embodiment of the present invention illustrated in FIG. 12 is applied, the same portions as in the flush water tank device 4, to which the discharge valve operating device 1 according to the first embodiment of the present invention illustrated in FIG. 2 is applied, are denoted by the same reference numerals, and a description thereof will be omitted.

As illustrated in FIG. 12, the discharge valve operating device 200 according to the third embodiment of the present invention is structurally different from the discharge valve operating device 1 according to the first embodiment of the present invention in that the discharge valve operating device 200 includes a so-called operation lever type manual operation unit 208 which is different from the operation button type manual operation unit 8 of the discharge valve operating device 1 according to the first embodiment of the present invention illustrated in FIG. 2.

As illustrated in FIG. 12, the manual operation unit 208 of the discharge valve operating device 200 according to the present embodiment includes an operation lever 230, a casing 46, a first manual wire 254 for full-flush mode operation, and a second manual wire 256 for partial-flush mode operation.

Additionally, as illustrated in FIG. 12, the operation lever 230 of the manual operation unit 208 is arranged outside a left side surface as viewed from the front of a water storage tank 6.

As illustrated in FIG. 12, the casing 46 of the manual operation unit 208 is similar in internal structure to the casing 46 of the electric operation unit 10 in the discharge valve operating device 1 according to the first embodiment of the present invention and contains a first pulley 48, a second pulley 50, a return spring 52, and the like.

As illustrated in FIG. 12, projections (not illustrated) similar to the projection 54*a* for mounting of the first electric wire 54 and the projection 56*a* for mounting of the second electric wire 56 are provided at respective one ends of the first manual wire 254 for full-flush mode operation and the second manual wire 256 for partial-flush mode operation of the manual operation unit 208. The projections for mounting (not illustrated) on the one end sides of the manual wires 254 and 256 are coupled to respective wire mounting holes 48*a* and 50*a* of the first pulley 48 and the second pulley 50 inside the casing 46 of the manual operation unit 208.

Similarly, as illustrated in FIG. 12, projections (not illustrated) similar to the projection 54*b* for mounting of the first electric wire 54 and the projection 56*b* for mounting of the second electric wire 56 are provided at the respective other ends of the first manual wire 254 and the second manual wire 256 of the manual operation unit 208. The projections for mounting (not illustrated) on the other end sides of the manual wires 254 and 256 are coupled to respective manual wire mounting portions (not illustrated) similar to the wire mounting portions 16*b* and 16*c* of the spindle member 16 in the discharge valve device 14 according to the first embodiment inside a discharge valve device 214.

Projections 54*b* and 56*b* on the other end sides of electric wires 54 and 56 in an electric operation unit 10 are coupled to respective electric wire mounting portions (not illustrated) similar to the wire mounting portions 16*b* and 16*c* of the spindle member 16 in the discharge valve device 14 according to the first embodiment inside the discharge valve device 214. Here, one of the manual wire mounting portions (not illustrated) and the electric wire mounting portions (not illustrated) are provided at sites different from each other.

When any one of the manual wires 254 and 256 and the electric wires 54 and 56 is pulled up, a corresponding one of the manual wire mounting portions (not illustrated) and the electric wire mounting portions (not illustrated) is integrally pulled up, and a spindle member 16 and a discharge valve body 18 of the discharge valve device 214 are also pulled up.

As illustrated in FIG. 12, for example, the operation lever 230 is connected to one end of a rotating shaft (not illustrated) which is connected to a rotating shaft member (not illustrated) similar to the rotating shaft member 42 according to the first embodiment.

In the present embodiment, the pulleys 48 and 50 of the manual operation unit 208 are engageably/disengageably engaged with a projecting portion 42*c* of a rotating shaft member 42 at respective cut holes 62 and 64, as in the first embodiment.

For example, as illustrated in FIG. 12, the operation lever 230 is manually rotated about a rotation central axis O from an initial position P0, where a distal end of the operation lever 230 is located on a lower side, toward a near side (front side) in a first rotation direction R1 such that the distal end of the operation lever 230 is located on the front side. With this rotational operation, the projecting portion 42*c* of the rotating shaft member 42 engages with the cut hole 62 in the first pulley 48 inside the casing 46 of the manual operation unit 208, and the first pulley 48 alone rotates.

The first manual wire 254 alone is wound up by a first wind-up amount L1 by the first pulley 48, the first manual wire 254 for full-flush mode operation is pulled up, and the discharge valve body 18 of the discharge valve device 214 is pulled up from a closed valve position (an initial position) P0 to a maximum opened valve position P1 for a full-flush mode by a maximum pull-up amount H1 [mm].

As illustrated in FIG. 12, the operation lever 230 is manually rotated about the rotation central axis O from the initial position P0, where the distal end of the operation lever 230 is located on the lower side, toward a far side (rear side) in a second rotation direction R2 such that the distal end of the operation lever 230 is located on the rear side. With this rotational operation, the projecting portion 42*c* of the rotating shaft member 42 engages with the cut hole 64 in the second pulley 50 inside the casing 46 of the manual operation unit 208, and the second pulley 50 alone rotates.

The second manual wire 256 for partial-flush mode operation is pulled up, and the discharge valve body 18 of the discharge valve device 214 is pulled up from the closed valve position P0 to a highest opened valve position P2 for a partial-flush mode by a maximum pull-up amount H2 [mm] smaller than the pull-up amount H1 [mm] for full-flush mode operation (H2<H1).

The discharge valve operating device 200 according to the third embodiment of the present invention can independently rotate either one of the first pulley 48 and the second pulley 50 inside the casing 46 of the manual operation unit 208 in accordance with each operation mode of the manual operation unit 208.

Thus, the first pulley 48 and the second pulley 50 can operate smoothly while suppressing interference with each other.

The first manual wire 254 and the second manual wire 256 coupled to the first pulley 48 and the second pulley 50, respectively, can operate smoothly while suppressing interference with each other.

Since switching operation between a full-flush operation mode and a partial-flush operation mode which are different operation modes of the manual operation unit 208 can be accurately and smoothly performed, valve opening operation of the discharge valve body 18 of the discharge valve device 214 can be accurately performed in accordance with each flush mode.

As a result, the manual operability of the manual operation unit 208 in the discharge valve operating device 200 that performs valve opening operation of the discharge valve body 18 can be improved, and toilet flushing corresponding to each of a plurality of flush modes can be accurately executed.

Valve opening operation of the discharge valve body 18 of the discharge valve device 14 can be performed not only through electric operation by the electric operation unit 10 but also through manual operation of the operation lever 230 of the manual operation unit 208.

Thus, at the time of execution of toilet flushing, one of electric operation by the electric operation unit 10 and manual operation of the manual operation unit 208 can be properly selected and used in accordance with a user's preference.

Even if the need for maintenance or a problem arises in the electric operation unit 10 or trouble, such as a power failure, occurs, valve opening operation of the discharge valve body 18 of the discharge valve device 214 can be reliably performed through manual operation of the manual operation unit 208.

A discharge valve operating device according to a fourth embodiment of the present invention will be described with reference to FIG. 13.

Figure 13:
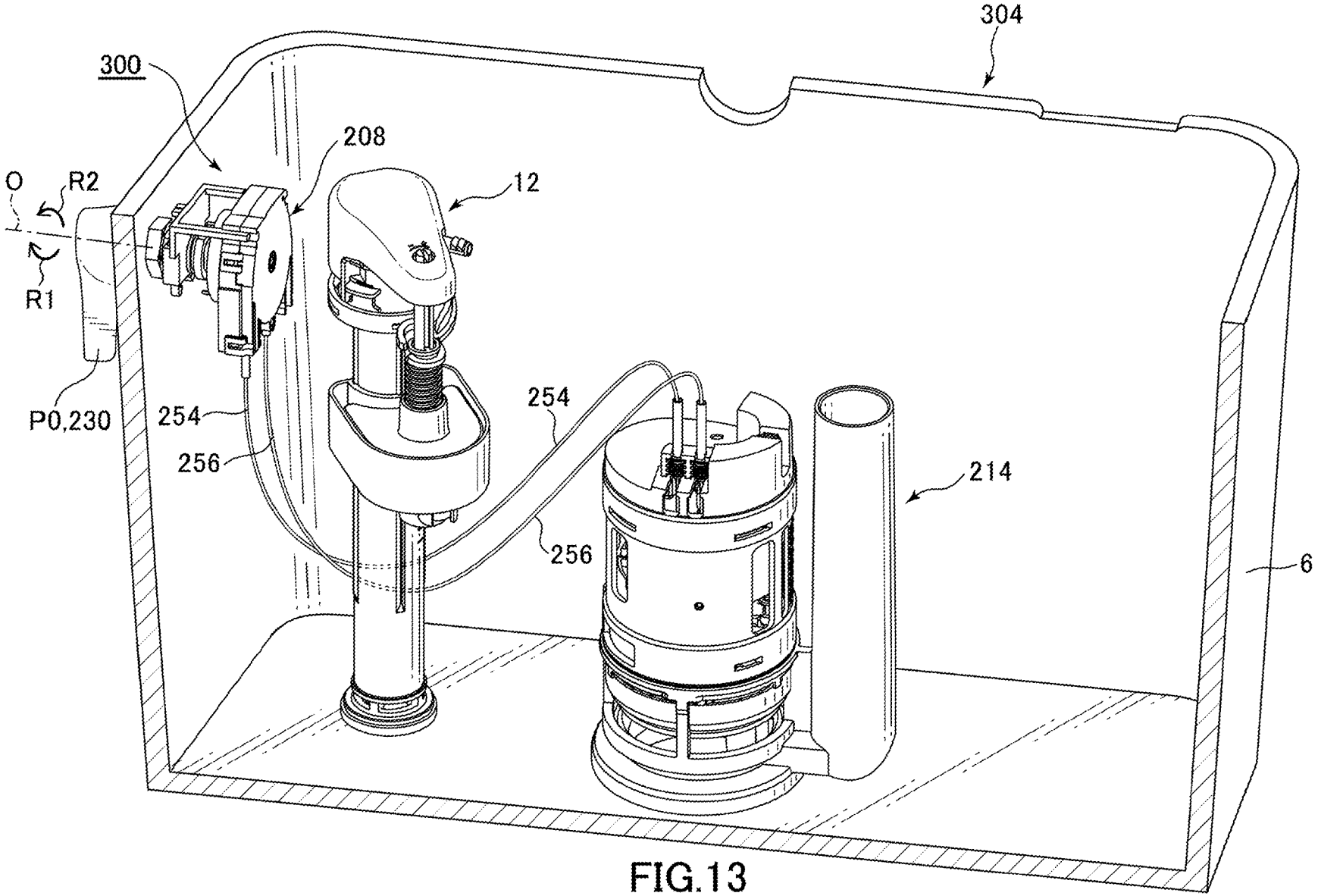
FIG. 13 is a schematic perspective view of an internal structure of a flush water tank device, to which a discharge valve operating device according to a fourth embodiment of the present invention is applied, as viewed obliquely from the front and above.

FIG. 13 is a schematic perspective view of an internal structure of a flush water tank device, to which the discharge valve operating device according to the fourth embodiment of the present invention is applied, as viewed obliquely from the front and above.

In a flush water tank device 304, to which a discharge valve operating device 300 according to the fourth embodiment of the present invention illustrated in FIG. 13 is applied, the same portions as in the flush water tank device 204, to which the discharge valve operating device 200 according to the third embodiment of the present invention illustrated in FIG. 12 is applied, are denoted by the same reference numerals, and a description thereof will be omitted.

As illustrated in FIG. 13, the discharge valve operating device 300 according to the fourth embodiment of the present invention is structurally different from the discharge valve operating device 200 according to the third embodiment of the present invention in that the discharge valve operating device 300 does not include the electric operation unit 10 illustrated in FIG. 12 but is identical in the rest.

In the discharge valve operating device 300 according to the present embodiment, internal space of the flush water tank device 304, such as space surrounding a discharge valve device 214, can be reduced by an amount corresponding to the omitted electric operation unit 10. This allows simplification of an internal structure of the flush water tank device 304.

Thus, the maintainability of a manual operation unit 208 and the discharge valve device 214 can be improved.

Note that, as for the above-described discharge valve operating devices 1 and 100 according to the first and second embodiments of the present invention, a form has been described in which toilet flushing in two full- and partial-flush modes is possible using the two electric wires 54 and 56 for full-flush mode operation and for partial-flush mode operation of the electric operation unit 10.

As for the above-described discharge valve operating device 200 according to the third embodiment of the present invention, a form has been described in which toilet flushing in two full- and partial-flush modes is possible using the two electric wires 54 and 56 for full-flush mode operation and for partial-flush mode operation of the electric operation unit 10 and the two manual wires 254 and 256 for full-flush mode operation and for partial-flush mode operation of the manual operation unit 208.

Additionally, as for the above-described discharge valve operating device 300 according to the fourth embodiment of the present invention, a form has been described in which toilet flushing in two full- and partial-flush modes is possible using the two manual wires 254 and 256 for full-flush mode operation and for partial-flush mode operation of the manual operation unit 208.

However, for example, toilet flushing in three full-, medium-, and partial-flush modes or four or more flush modes can be made possible by appropriately changing only the structure of the discharge valve device 14 or 214 without changing the two electric wires 54 and 56 of the electric operation unit 10 in each of the discharge valve operating devices 1, 100, and 200 according to the first to third embodiments of the present invention and the two manual wires 254 and 256 of the manual operation unit 208 in each of the discharge valve operating devices 200 and 300 according to the third and fourth embodiments of the present invention.

Additionally, as for the discharge valve operating devices 1, 100, 200, and 300 according to the first to fourth embodiments of the present invention, a form has been described in which the projection 66 for rotation restriction of the second casing **46*b* is used as a male side of means for restricting rotation angles of the pulleys 48 and 50, and the guide grooves 48*b* and 50*b* for rotation restriction of the pulleys 48 and 50** are used as a female side. The male side and the female side may be interchanged.

What is claimed is:

1. A discharge valve operating device configured to perform valve opening operation of a discharge valve in a flush water tank device which supplies flush water to a toilet, comprising:

an operation device including a rotating shaft and being operated by first and second operation modes, the operating portion being configured to rotate the rotating shaft in a first direction on the first operation mode and to rotate the rotating shaft in a second direction opposite to the first rotation direction on the second operation mode;

first and second coupling members in which each one end of the first and second coupling members is coupled to the discharge valve;

a first rotary winding member configured to be mounted to the rotating shaft so as to be engageable and disengageable in a rotation direction, an other end of the first coupling member being coupled to the first rotary winding member, the first rotary winding member being configured to wind up the first coupling member when the first rotary winding member rotates together with the rotating shaft in the first rotation direction; and a second rotary winding member configured to be mounted to the rotating shaft so as to be engageable and disengageable in the rotation direction, an other end of the second coupling member being coupled to the second rotary winding member, the second rotary winding member being configured to wind up the second coupling member when the second rotary winding member rotates together with the rotating shaft in the second rotation direction, independently of the first rotary winding member, wherein the first rotary winding member and the second rotary winding member respectively include a first holed portion and a second holed portion, which are provided near respective rotation centers, and each of the holed portions is engageable and disengageable with/from the rotating shaft in the rotation direction in accordance with the rotation direction of the rotating shaft in each of the operation modes, when the rotating shaft is rotated in the first rotation direction in the first operation mode of the operation device, the first holed portion of the first rotary winding member is configured to rotate in the first rotation direction in a state of being engaged with the rotating shaft in the rotation direction while the second holed portion of the second rotary winding member is configured to be brought out of engagement with the rotating shaft in the rotation direction and enter a stationary state, and the discharge valve is configured to be pulled up by a first amount when the first coupling member alone is wound up by the first amount by the first rotary winding member, and toilet flushing in a first flush mode is executable when a first flush water amount of flush water is supplied from the flush water tank device to the toilet, and when the rotating shaft is rotated in the second rotation direction in the second operation mode of the operation device, the first holed portion of the first rotary winding member is configured to be brought out of engagement with the rotating shaft in the rotation direction and enter a stationary state while the second holed portion of the second rotary winding member is configured to rotate in the second rotation direction in a state of being engaged with the rotating shaft in the rotation direction, and the discharge valve is configured to be pulled up by a second amount different from the first amount when the second coupling member alone is wound up by the second amount by the second rotary winding member, and toilet flushing in a second flush mode is executable when a second flush water amount different from the first flush water amount of flush water is supplied from the flush water tank device to the toilet.

2. The discharge valve operating device according to claim 1, wherein the operation device is an electric operation device which includes an electric rotating shaft coupled to the rotating shaft and capable of electrically rotationally driving the rotating shaft by external power, and the first rotary winding member and the second rotary winding member are rotatable with rotation radiuses larger than respective rotation radiuses of the electric rotating shaft and the rotating shaft by being rotationally driven by the electric rotating shaft.

3. The discharge valve operating device according to claim 1, wherein the operation device is a manual operation device which includes an operation member coupled to the rotating shaft and capable of manually rotationally driving the rotating shaft.

4. The discharge valve operating device according to claim 2, wherein the first rotary winding member is rotatable independently with the rotation radius that is almost identical to the rotation radius of the second rotary winding member between an initial position where the discharge valve is closed and is at a lowest position and a first maximum rotation position where the discharge valve is opened and is at a first highest position in the first operation mode of the operation device, the second rotary winding member is rotatable independently with the rotation radius that is almost identical to the rotation radius of the first rotary winding member between the initial position and a second maximum rotation position where the discharge valve is opened and is at a second highest position different from the first highest position in the second operation mode of the operation device, a first maximum rotation angle when the first rotary winding member rotates from the initial position to the first maximum rotation position in the first rotation direction is set larger than a second maximum rotation angle when the second rotary winding member rotates from the initial position to the second maximum rotation position in the second rotation direction, and the first amount, by which the first coupling member alone is wound up by the first rotary winding member, is set larger than the second amount, by which the second coupling member alone is wound up by the second rotary winding member, and the first flush water amount for supply from the flush water tank device to the toilet in the first flush mode is set larger than the second flush water amount for supply from the flush water tank device to the toilet in the second flush mode.

5. The discharge valve operating device according to claim 4, further comprising a biasing member which is provided to the first rotary winding member and the second rotary winding member, the biasing member being configured to be capable of biasing the first rotary winding member at the first maximum rotation position and the second rotary winding member at the second maximum rotation position such that the first rotary winding member and the second rotary winding member return to the initial position.

6. The discharge valve operating device according to claim 5, wherein the biasing member is a torsion coil spring which is provided on a central axis almost identical to central axes of the first rotary winding member and the second rotary winding member, the torsion coil spring including a first arm portion and a second arm portion extending outward from one end and the other end, respectively, of the torsion coil spring, the first rotary winding member includes a first arm mounting portion, to which one of the first arm portion and the second arm portion is mounted, the second rotary winding member includes a second arm mounting portion, to which the other of the first arm portion and the second arm portion is mounted, the first arm portion of the torsion coil spring is configured to bias the first arm mounting portion of the first rotary winding member at the first maximum rotation position in the second rotation direction and return the first rotary winding member to the initial position, and the second arm portion of the torsion coil spring is configured to bias the second arm mounting portion of the second rotary winding member at the second maximum rotation position in the first rotation direction and return the second rotary winding member to the initial position.

7. The discharge valve operating device according to claim 4, wherein the rotating shaft includes a rotating shaft body portion which extends in an axial direction of the rotating shaft and a projecting portion which protrudes outward from a part of an outer peripheral surface of the rotating shaft body portion, the projecting portion including a first projection side surface which is formed on a side facing the first rotation direction and a second projection side surface which is formed on a side facing the second rotation direction of the first projection side surface, and the first holed portion of the first rotary winding member and the second holed portion of the second rotary winding member are formed near the portions at the respective rotation centers of the first rotary winding member and the second rotary winding member such that the rotating shaft is insertable in the axial direction and include a first engagement-avoidance region and a second engagement-avoidance region, respectively, where engagement with the projecting portion of the rotating shaft is avoidable in accordance with the rotation direction of the rotating shaft.

8. The discharge valve operating device according to claim 7, wherein the first holed portion of the first rotary winding member includes a first hole side surface which engages with the first projection side surface of the rotating shaft at the initial position and a second hole side surface which is separated from the first hole side surface in the second rotation direction, the second holed portion of the second rotary winding member includes a third hole side surface which engages with the second projection side surface of the rotating shaft at the initial position and a fourth hole side surface which is separated from the third hole side surface in the first rotation direction, in the first engagement-avoidance region, engagement between the second projection side surface of the projecting portion in the rotating shaft and the second hole side surface of the first holed portion in the first rotary winding member is avoidable when the rotating shaft is located between the initial position and the second maximum rotation position, and in the second engagement-avoidance region, engagement between the first projection side surface of the projecting portion in the rotating shaft and the fourth hole side surface of the second holed portion in the second rotary winding member is avoidable when the rotating shaft is located between the initial position and the first maximum rotation position.

9. The discharge valve operating device according to claim 8, wherein if the rotating shaft is rotated from the initial position in the first rotation direction in the first operation mode of the operation device, the first hole side surface of the first holed portion in the first rotary winding member and the first projection side surface of the rotating shaft are kept in engagement with each other in the first engagement-avoidance region, and the third hole side surface of the second holed portion in the second rotary winding member and the second projection side surface of the rotating shaft are brought out of engagement with each other in the second engagement-avoidance region, and if the rotating shaft is rotated from the initial position in the second rotation direction in the second operation mode of the operation device, the third hole side surface of the second holed portion in the second rotary winding member and the second projection side surface of the rotating shaft are kept in engagement with each other in the second engagement-avoidance region, and the first hole side surface of the first holed portion in the first rotary winding member and the first projection side surface of the rotating shaft are brought out of engagement with each other in the first engagement-avoidance region.

10. The discharge valve operating device according to claim 4, wherein the first rotary winding member and the second rotary winding member include a first mounting portion and a second mounting portion, respectively, to which the respective other ends of the first coupling member and the second coupling member are mountable, at respective outer peripheries, the mounting portions being arranged on a line almost parallel to directions of respective rotation central axes of the first rotary winding member and the second rotary winding member at the initial position, the first coupling member and the second coupling member are arranged symmetrically on one side and the other side of the rotation centers of the first rotary winding member and the second rotary winding member in elevation view, and at the initial position, the first mounting portion of the first rotary winding member and the other end of the first coupling member are set at a position where the first coupling member is wound up in advance in the first rotation direction along the outer periphery of the first rotary winding member by a predetermined length, and the second mounting portion of the second rotary winding member and the other end of the second coupling member are set at a position where the second coupling member is wound up in advance in the second rotation direction along the outer periphery of the second rotary winding member by the predetermined length.

11. The discharge valve operating device according to claim 1, further comprising a holding portion which rotatably holds the first rotary winding member and the second rotary winding member, wherein the holding portion includes a rotation angle limiting portion which is capable of limiting a range of a rotation angle between the initial position and the first maximum rotation position of the first rotary winding member and limiting a range of a rotation angle between the initial position and the second maximum rotation position of the second rotary winding member.

12. The discharge valve operating device according to claim 11, wherein the first rotary winding member includes a first engaging portion which is engageable with the rotation angle limiting portion of the holding portion at the initial position and a second engaging portion which is engageable with the rotation angle limiting portion at the first maximum rotation position, and the second rotary winding member includes a third engaging portion which is engageable with the rotation angle limiting portion of the holding portion at the initial position and a fourth engaging portion which is engageable with the rotation angle limiting portion at the second maximum rotation position.

13. The discharge valve operating device according to claim 12, wherein the one end of the first coupling member is engageably/disengageably coupled to a first coupling portion of the discharge valve, and the one end of the second coupling member is engageably/disengageably coupled to a second coupling portion which is adjacent to the first coupling portion of the discharge valve.

14. The discharge valve operating device according to claim 2, further comprising a manual operation device which is capable of the valve opening operation of the discharge valve through manual press operation.

15. A flush water tank device comprising a discharge valve operating device according to claim 1.

16. A flush toilet comprising a flush water tank device according to claim 15.

* * * * *